US008894177B2

(12) United States Patent
Yoshikawa et al.

(10) Patent No.: US 8,894,177 B2
(45) Date of Patent: Nov. 25, 2014

(54) RECORDING METHOD TO DETERMINE WHETHER A NOZZLE PERFORMING DEFECTIVE DISCHARGE EXISTS IN A RECORDING APPARATUS

(75) Inventors: Hirokazu Yoshikawa, Yokohama (JP); Hidehiko Kanda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 418 days.

(21) Appl. No.: 12/816,290

(22) Filed: Jun. 15, 2010

(65) Prior Publication Data

US 2010/0328383 A1 Dec. 30, 2010

(30) Foreign Application Priority Data

Jun. 30, 2009 (JP) ..... 2009-155671

(51) Int. Cl.

| | |
|---|---|
| ***B41J 29/393*** | (2006.01) |
| ***B41J 2/21*** | (2006.01) |
| ***B41J 29/38*** | (2006.01) |
| ***B41J 2/045*** | (2006.01) |

(52) U.S. Cl.

CPC ..... *B41J 29/38* (2013.01); *B41J 2/2142* (2013.01); *B41J 2029/3935* (2013.01); *B41J 2/04558* (2013.01); *B41J 2/0451* (2013.01); *B41J 29/393* (2013.01)

USPC ..... 347/19

(58) Field of Classification Search

CPC ..... B41J 2/0451; B41J 2/2142

USPC ..... 347/19

See application file for complete search history.

(56) References Cited

U.S. PATENT DOCUMENTS

| | | | | |
|---|---|---|---|---|
| 5,530,460 | A * | 6/1996 | Wehl | 347/19 |
| 6,347,855 | B1 * | 2/2002 | Takanaka | 347/19 |
| 7,384,110 | B2 * | 6/2008 | Hoshiyama et al. | 347/9 |

FOREIGN PATENT DOCUMENTS

| | | | |
|---|---|---|---|
| JP | 09-136405 | A | 5/1997 |
| JP | 2002-86773 | A | 3/2002 |
| JP | 2002-361988 | A | 12/2002 |
| JP | 2004-358965 | A | 12/2004 |

* cited by examiner

*Primary Examiner* — Julian Huffman

(74) *Attorney, Agent, or Firm* — Canon USA, Inc., IP Division

(57) ABSTRACT

A pattern forming method that includes forming a pattern for detecting defective discharges of a plurality of ink discharging nozzles and recording a first dot pattern with the plurality of ink discharging nozzles. The pattern forming method also includes recording a second dot pattern to be adjacent to at least one side of the first dot pattern in the predetermined direction.

18 Claims, 14 Drawing Sheets

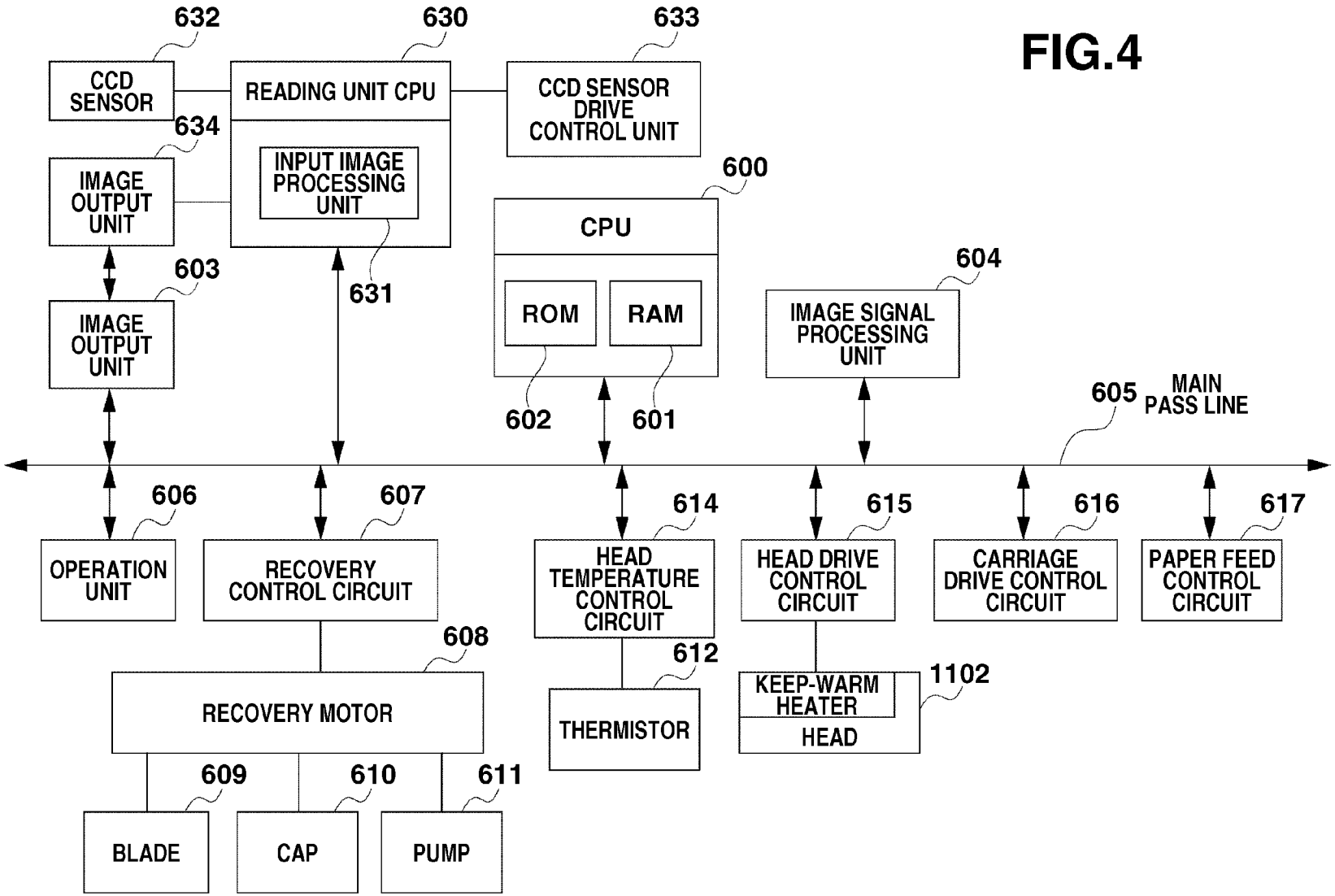
FIG.4
MAIN PASS LINE
605
617
PAPER FEED CONTROL CIRCUIT
616
CARRIAGE DRIVE CONTROL CIRCUIT
604
IMAGE SIGNAL PROCESSING UNIT
615
HEAD DRIVE CONTROL CIRCUIT
1102
KEEP-WARM HEATER
HEAD
600
CPU
RAM
601
ROM
602
614
HEAD TEMPERATURE CONTROL CIRCUIT
612
THERMISTOR
633
CCD SENSOR DRIVE CONTROL UNIT
630
READING UNIT CPU
INPUT IMAGE PROCESSING UNIT
631
607
RECOVERY CONTROL CIRCUIT
608
RECOVERY MOTOR
611
PUMP
610
CAP
609
BLADE
632
CCD SENSOR
634
IMAGE OUTPUT UNIT
603
IMAGE OUTPUT UNIT
606
OPERATION UNIT

FIG.13
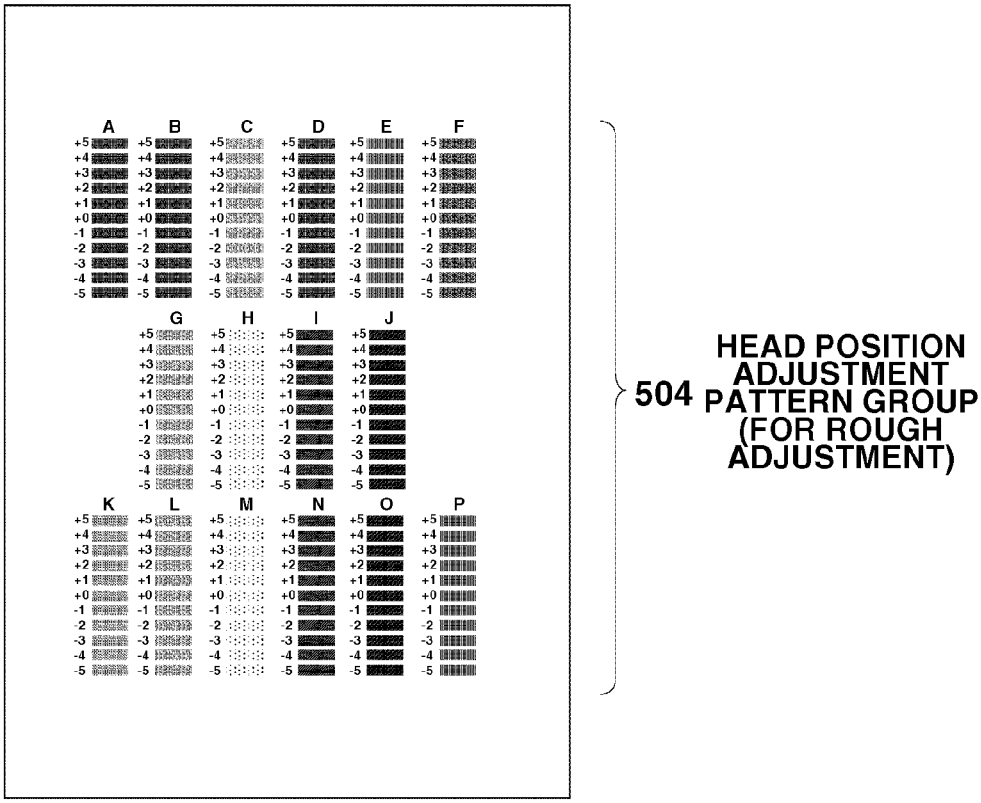
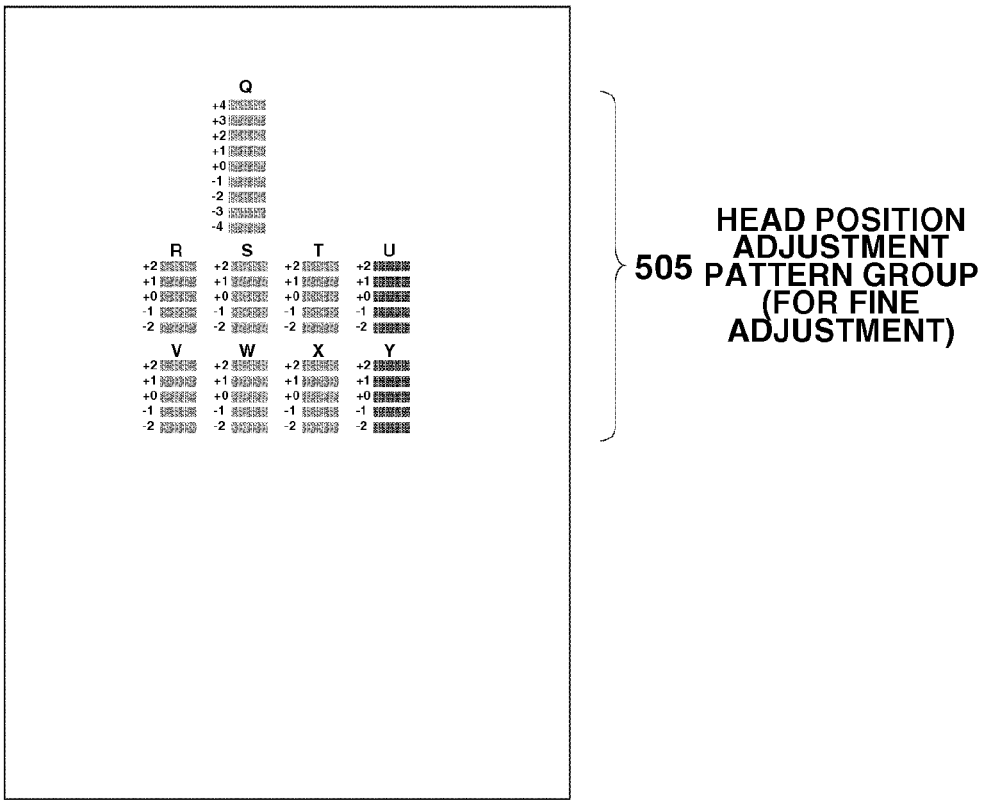

RECORDING METHOD TO DETERMINE WHETHER A NOZZLE PERFORMING DEFECTIVE DISCHARGE EXISTS IN A RECORDING APPARATUS

BACKGROUND OF THE INVENTION

1. Field of the Invention

The present invention relates to a recording apparatus that discharges ink from a recording head and performs recording, and a pattern forming method for detecting defective discharge of the recording head.

2. Description of the Related Art

In an ink jet recording apparatus, one of causes for quality deterioration of a recorded image is defective discharge of ink from the recording head. In a conventional method for detecting defective discharge from the recording head, a user records a test image (a defective discharge detection pattern) on a recording medium, and visually checks whether the recorded test image includes recording omissions due to the defective discharge. Recently, the recording apparatus has detected defective discharge by reading the recorded recording medium using an optical sensor attached to a carriage or a scanner unit instead of visual detection.

However, both the visual method and the method using the optical sensor have a common problem in that the occurrence of the defective discharge barely is detected when the defective discharge occurs at an end of a nozzle array of the recording head. That is, when the defective discharge occurs at the center of the nozzle array, a slit-like recording omission occurs in the test image, so that a user can easily detect the defective discharge. However, when the recording omission occurs at an end of the nozzle array, the recording omission does not appear as a slit-like recording omission generated at the center of the nozzle array, so that the user tends to misunderstand that the discharging state is normal. In addition, when a user wants to detect whether the defective discharge occurs at only a part of the nozzle array (a nozzle group), the operator records the test image using only a part of the nozzle array. In such a case, the similar problem occurs.

To solve the aforementioned problem, Japanese Patent Application Laid-Open No. 2002-86773 discusses a method that detects defective discharge of a recording head by differently recording a test image of both ends of a nozzle array and a test image of the center of the nozzle array.

The method discussed in Japanese Patent Application Laid-Open No. 2002-86773 can more easily detect the defective discharge at the ends of the nozzle array. However, when the defective discharge occurs at the ends of the nozzle array, the ends of the test image are missed. Therefore, in both cases of the visual method or the method using the optical sensor, there is a problem that a user hardly detects the defective discharge compared with the case where the slit-like recording omission is generated at the center of the test image. Particularly, when the optical sensor with a small number of effective elements is used, the defective discharge at the ends of the nozzle array is not detected correctly. The optical sensor having a large number of effective elements can record an image that becomes a position reference (e.g., a black point having about 1 millimeter (mm) diameter) on the recording medium, and acquire position information of the test image. However, the optical sensor having a small number of effective elements cannot acquire the position information of the test image. Therefore, even when the defective discharge occurs at the ends of the nozzle array, a user recognizes that an end of a discharging part is an end of the test image, and cannot detect the defective discharge at the end of the nozzle array.

SUMMARY OF THE INVENTION

The present invention is directed to provide a recording apparatus that can detect occurrence of defective discharge by detecting whether a recording omission occurs at a center of a pattern.

According to an aspect of the present invention, a pattern forming method includes forming a pattern on a recording medium using a recording head having a plurality of ink discharging nozzles, which are for discharging ink arranged in the predetermined direction. The pattern is used for detecting defective discharge of the plurality of ink discharging nozzles, and includes a first dot pattern and a second dot pattern. The pattern forming method also includes recording the first dot pattern with the plurality of ink discharging nozzles, and recording the second dot pattern to be adjacent to at least one side of the first dot pattern in the predetermined direction.

According to another aspect of the present invention, a recording apparatus includes a recording unit to record an image on a recording medium by using a recording head having a plurality of ink discharging nozzles for discharging ink arranged in the predetermined direction. The recording apparatus also includes a control unit to cause the plurality of ink discharging nozzles of the recording head to record a first dot pattern. The control unit is further configured to record a second dot pattern to be adjacent to at least one side of the first dot pattern in the predetermined direction.

According to the present invention, a user can detect occurrence of defective discharge by detecting whether a recording omission occurs at a center of a pattern. Thus, detection of defective discharge becomes easy.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4 is a block diagram illustrating a control configuration of an ink jet recording apparatus.

FIG. 13 illustrates recording examples of a manually set defective discharge detection pattern group and a manually set recording position adjustment pattern group.

DESCRIPTION OF THE EMBODIMENTS

Various exemplary embodiments, features, and aspects of the invention will be described in detail below with reference to the drawings.

Figure 1A:
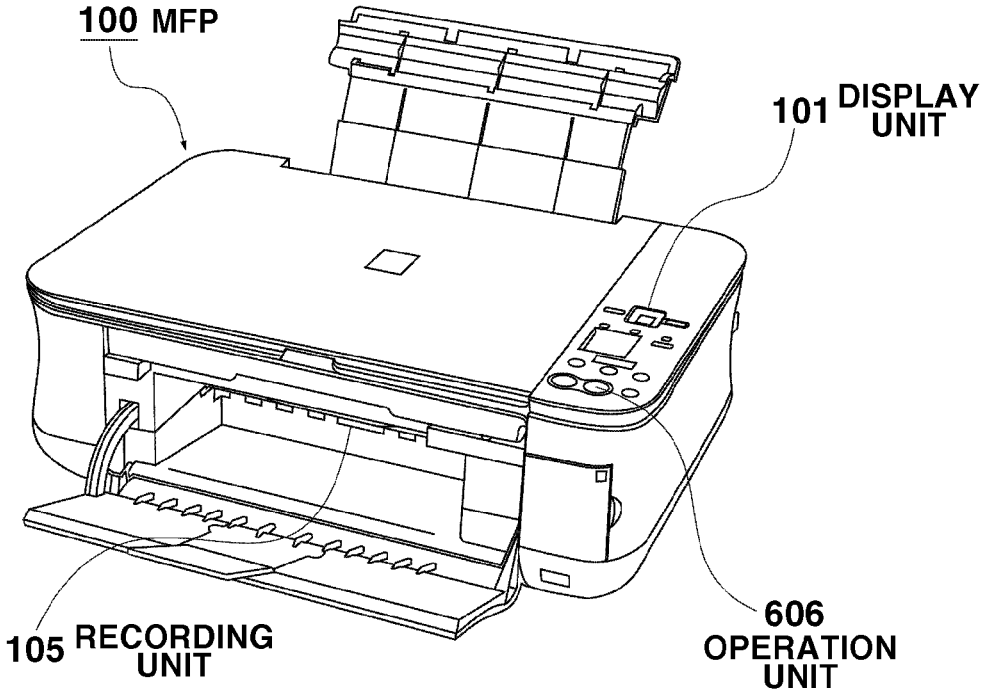
FIGS. 1A and 1B are perspective views illustrating an ink jet recording apparatus in which the present invention can be applied.
Figure 1B:
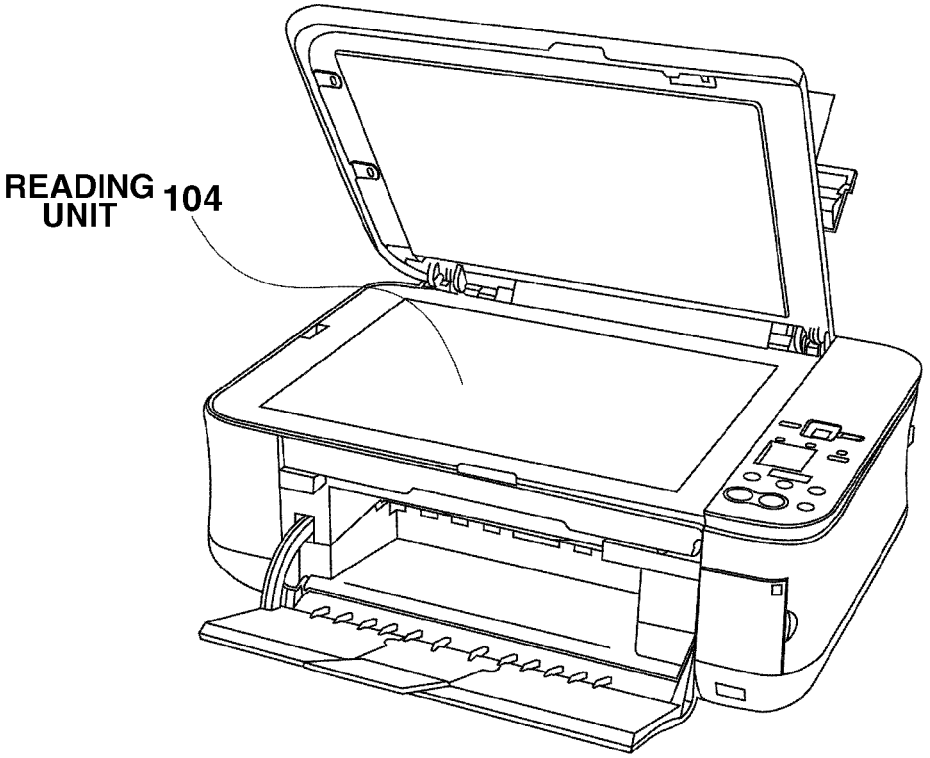

FIG. 1 is an apparatus perspective view schematically illustrating a multi function printer (MFP) 100 as an example of an inkjet recording apparatus to which the present invention can be applied. As illustrated in FIGS. 1A and 1B, the MFP 100 includes a display unit 101, a reading unit 104, a recording unit 105, and an operation unit 606.

As illustrated in FIG. 1A, the MFP 100 is installed in a state where the reading unit 104 is closed. When a recording medium is scanned, the user opens a reading cover of the reading unit 104, and puts a document on a glass plate, as illustrated in FIG. 1B. Then, the user closes the reading cover and causes the MFP 100 to execute desired functions, such as a copy function and a scanner function, by pressing a start key provided at the operation unit 606.

Figure 2:
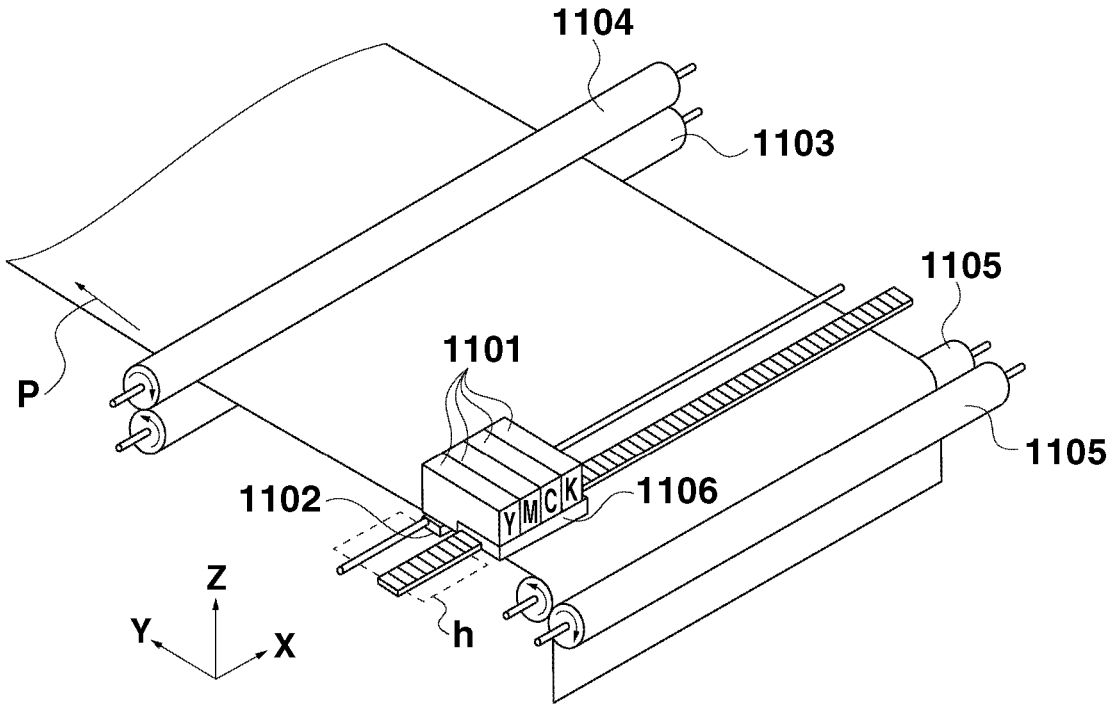
FIG. 2 is a perspective view illustrating a configuration of a recording unit.

FIG. 2 illustrates a configuration of the recording unit 105. In FIG. 2, the recording unit 105 has ink jet cartridges 1101. These ink jet cartridges 1101 include ink tanks respectively storing four color inks of black, cyan, magenta, and yellow, and also include a recording head 1102 having nozzle arrays corresponding to each color ink.

Figure 3:
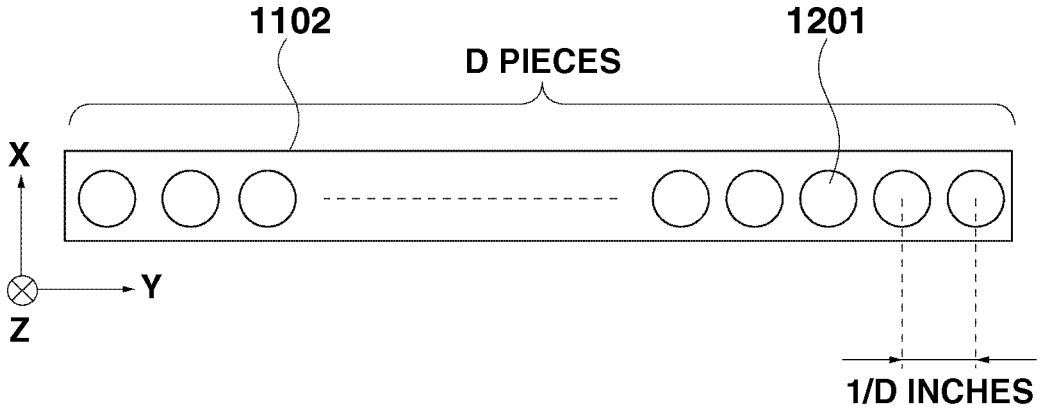
FIG. 3 is a schematic view illustrating a surface of a discharge port of a recording head.

FIG. 3 is a schematic view illustrating a discharge port array (nozzle array) of a certain color, which is provided at the recording head 1102, and the discharge port array is seen from the z direction in FIG. 2. In FIG. 3, a nozzle array 1201 includes d pieces of discharge ports (nozzles) arrayed at a nozzle density of D dots per inch (D dpi).

In FIG. 2, a paper sheet roller 1103 rotates in an arrow direction in FIG. 2 while holding a recording medium P together with an assist roller 1104, and conveys the recording medium P at any time in the y direction (a sub-scanning direction, a conveying direction, a paper feeding direction). A pair of paper rollers 1105 feeds the recording medium P. The pair of paper rollers 1105 rotates holding the recording medium P, like the rollers 1103 and 1104. However, the pair of the paper rollers 1105 can rotate at a smaller rotation speed than the paper sheet roller 1103, so that tensile force can act to the recording medium P. A carriage 1106 supports the four ink jet cartridges 1101, and causes them to perform recording and scanning. When the carriage 1106 stops recording or the MFP 100 performs recovery processing for the recording head 1102, the carriage 1106 stands by at a home position h illustrated with a dashed line in FIG. 2.

When the carriage 1106 standing by at the home position h before starting recording receives a recording start command, the carriage 1106 performs recording with a width of d/D inches on a paper by the nozzle array 1201 on which the d pieces of nozzles are arrayed at a density of D dots per one inch, while moving toward the x direction (main scanning direction). Before starting the second recording after ending the first recording, the paper sheet roller 1103 rotates in the arrow direction, and feeds the paper toward the y direction by the width d/D inches.

By this way, the recording unit 105 repeatedly performs recording having a width d/D inches for every one main scanning of the carriage 1106 by the recording head 1102 (recording a width of one inch on a recording medium by using D pieces of nozzles) and paper feeding, and can complete recording for 1 page. Such a recording mode will be referred to as a one-pass recording mode below.

In another recording mode, when the carriage 1106 standing by at the home position h before starting recording receives a recording start command, the carriage 1106 performs recording having a width d/D inches on a paper by the d pieces of nozzles of the nozzle array 1201, while moving toward the x direction (the forward direction of main scanning).

These dots are recorded at this time by scanning and thinning prescribed image data with a predetermined image to be a half. The paper sheet roller 1103 rotates in the arrow direction before starting second recording after ending the first recording, and feeds a paper in the y direction by a width d/2D inches.

In the second scanning, the carriage 1106 scans the recording medium in the inverse direction to the first recording, records each image, and completes recording within an area corresponding to each nozzle. Such another recording mode will be referred to as a two-pass recording mode. M-pass (M≥2) recording will be generally referred to as a multi-pass recording mode below. The multi-pass recording mode is optimum when recording a photo image with high quality.

FIG. 4 is a block diagram illustrating a control configuration of an ink jet recording apparatus according to the first exemplary embodiment. In FIG. 4, a central processing unit (CPU) 600 controls each unit and executes data processing via a main bus line 605. More specifically, the CPU 600 controls a head drive control, a carriage drive control, and data processing via each unit described below, according to a program stored in a read only memory (ROM) 601. The ROM 601 also stores a program to execute defective discharge detection processing and a head position adjustment processing, which will be described below.

A random access memory (RAM) 602 is used as a work area for data processing by the CPU 600, and a hard disk may be used instead of the RAM 602. The RAM 602 also has a function as a storage means for storing an adjustment value determined in the head position adjustment processing. An image input unit 603 has an interface with a host apparatus (not illustrated), and temporarily stores an image input from the host apparatus. An image signal processing unit 604 executes color conversion, binarization, and data processing.

A CPU 630 controlling the reading unit 104 stores an input image processing unit 631, and connects with a charge coupled device (CCD) sensor 632, a CCD sensor driving unit 633, an image output unit 634, and a main bus line 605. The CCD sensor driving unit 633 controls input driving of the CCD sensor 632. The input image processing unit 631 performs processing of a signal received from the CCD sensor 632, such as A/D conversion and shading correction. An image processed by the input image processing unit 631 is transmitted to the image input unit 603 via the image output unit 634.

The operation unit 606 includes a start key, and an operator can perform control to input using the start key. A recovery control circuit 607 controls a recovery operation, such as preliminary discharge, according to a recovery processing program stored in the RAM 602. More specifically, a recovery motor 608 drives the recording head 1102, a cleaning blade 609, a cap 610, and a suction pump 611. The cleaning blade 609, the cap 610, and the suction pump 611 are opposed to and separated from the recording head 1102.

A head drive control circuit 615 controls driving of an ink discharge electrothermal converter of the recording head 1102, and usually causes the recording head 1102 to perform ink discharge for preliminary discharge or recording. Similarly, a carriage drive control circuit 616 and a paper feed control circuit 617 control moving of the carriage 1106 and paper feeding according to the program.

A substrate including the ink discharging electrothermal converter in the recording head 1102 includes a keep-warm heater, so that the keep-warm heater can heat and adjust an ink temperature in the recording head 1102 at a desired setting temperature. Similarly, a thermistor 612 is provided in the substrate, and measures a substantial ink temperature inside of the recording head. The thermistor 612 can be provided outside the substrate instead of inside, and can be provided around the recording head 1102.

The defective discharge detection processing according to the first exemplary embodiment will be described below. Firstly, a recording method of a test image (a pattern for detecting defective discharge) will be described. In the present exemplary embodiment, the nozzle array 1201, which is a target for detecting defective discharge, is a cyan array discharging cyan ink in the recording head 1102, and the number of nozzles d is 32.

In the recording method of the test image (the pattern forming method) in the present exemplary embodiment, the recording unit 105 scans the recording head 1102 along the x direction, and records a solid image by 16 dots with recording resolution of 600 dpi in the x direction by 32 nozzles in the cyan array. After the first recording scanning (first scanning) ends, the recording unit 105 feeds a paper by a width of the cyan array (32 dots/600 inches) in the y direction. Then, the recording unit 105 scans the recording head 1102 in the same direction as the first scanning, and records the same solid image as the previous image recorded in the first scan to be adjacent to the previous image. In recording the image by this scanning (the second scanning), the recording unit 105 starts recording from the same position as the previous image in the X direction, and a recording width (a length in the x direction) is the same recording width as the previous image, which is 16 dots with recording resolution of 600 dpi.

Figure 7A:
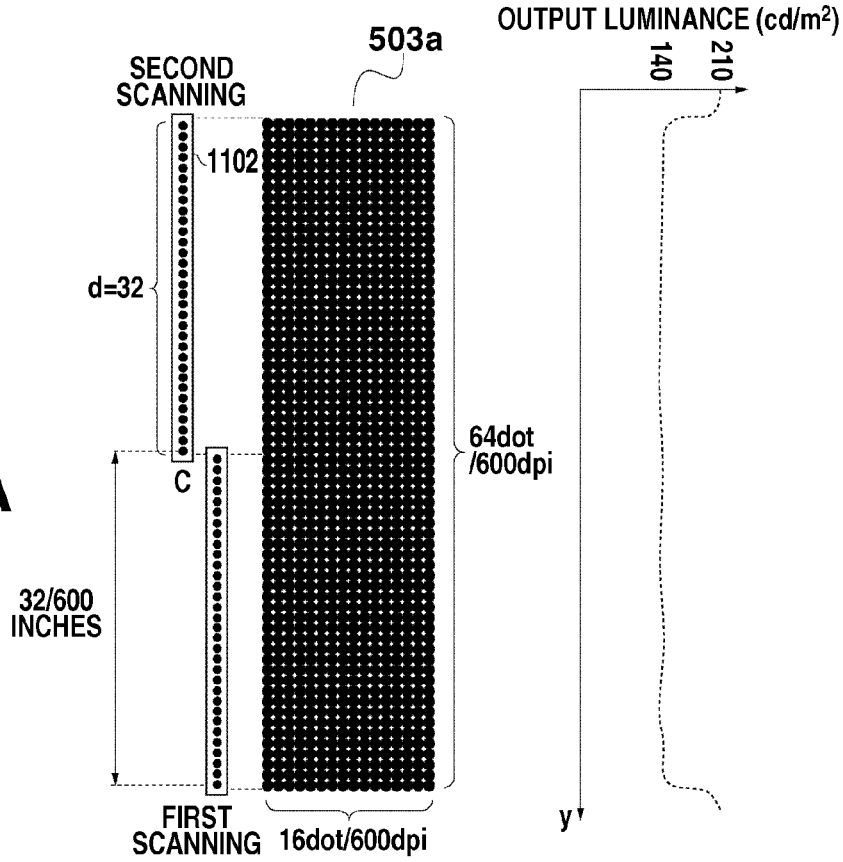
FIGS. 7A and 7B illustrate a recording method of a defective discharge detection pattern according a first exemplary embodiment.
Figure 7B:
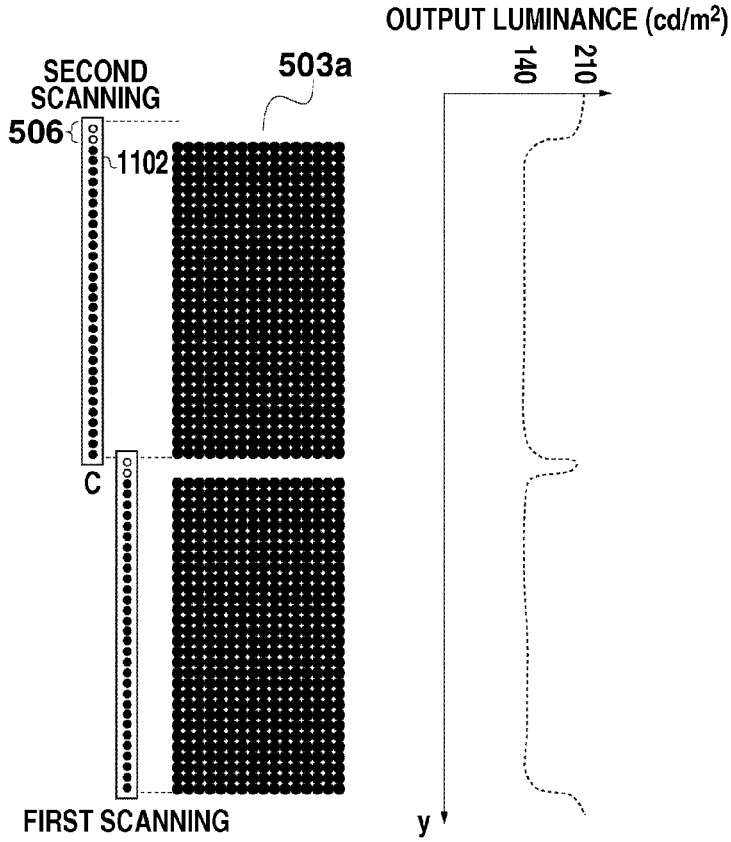

FIG. 7 illustrates a test image 503*a* (a defective discharge detection pattern) to be recorded on a recording medium, and change of luminance of the test image 503*a* in the y direction. FIG. 7A illustrates the cyan array that does not include a nozzle having defective discharge. FIG. 7B illustrates the cyan array that includes a nozzle having defective discharge. In a graph illustrating luminance of the test image 503*a*, an average of luminance is plotted in the x direction, and an average of luminance at each position is plotted in the y direction.

As illustrated in FIG. 7A, when the cyan array does not include a nozzle having defective discharge, the test image 503*a* becomes a solid image having a uniform dot density. Thus, a user can determine that there will be no problem when the recording unit 105 records an image that is desired by the user on a recording medium. Further, as illustrated in the graph indicating the luminance change, the luminance of the recording medium is 210 cd/m$^2$. By contrast, the recorded test image 503*a* has the uniform luminance of 140 cd/m$^2$.

On the other hand, FIG. 7B illustrates the test image 503*a* where two nozzles as the defective discharge nozzle 506 are generated at an end on the upstream side of the nozzle array in the paper feeding direction. According to the test image in the present exemplary embodiment, when the end of the nozzle array includes the defective discharge nozzles, a slit-like recording omission (a space portion in which a dot is not recorded) is formed, so that a user can easily detect occurrence of defective discharge. Further, luminance of the recording medium is 210 cd/m$^2$. By contrast, the luminance of a solid image portion of the recorded test image is 140 cd/m$^2$, and luminance of a part of the slit-like recording omission is 210 cd/m$^2$, which is the same luminance as the recording medium.

When a user is to determine the occurrence of defective discharge, the user sees the test image at first, and do input indicating whether the test image includes the slit-like recording omission, to the operation unit 606. When the user do the input indicating that the test image includes the recording omission, the recording apparatus executes predetermined recovery processing, and ends a defective discharge detection processing. Next, the recording apparatus that uses an optical sensor to determine the occurrence of defective discharge will be described. In the optical sensor of the present exemplary embodiment, the number of effective elements is 300 dpi, which is lower than the nozzle resolution of 600 dpi of the nozzle array. First, the recording unit 105 scans with the optical sensor in the same direction as the recording head, and measures average luminance at each position in the y direction. In the graph of the measured luminance change, if the CPU 600 determines that the sum calculated by integrating the part 508 having the slit-like recording omission in the test image is equal to or larger than a predetermined number (10 or more in the present exemplary embodiment), the CPU 600 determines that there is a problem in image recording. Then, the CPU 600 executes the predetermined recovery processing, and ends the defective discharge detection processing. Accordingly, although the optical sensor of the present exemplary embodiment has the number of effective elements of 300 dpi, which is lower than the nozzle resolution of 600 dpi of the nozzle array, the recording omission due to the defective discharge nozzle is formed at the center of a pattern, so that the user can easily detect the occurrence of the defective discharge nozzle.

According to the present exemplary embodiment, the recording unit 105 records the first dot pattern (image) by the predetermined nozzle array, which is a target for detecting defective discharge, records the second dot pattern at a position adjacent to the first dot pattern in the paper feed direction, and completes the defective discharge detection pattern. In addition to the solid image, the first dot pattern can be a checkered pattern as long as the pattern is designed to detect defective discharge. The recording unit 105 can record the second dot pattern by a nozzle array different from a nozzle array that records the first dot pattern. For example, in the present exemplary embodiment, the recording unit 105 can record the second dot pattern by using a nozzle array that is a part of the cyan array or, instead of using the cyan array, by using the other nozzle array (e.g., a magenta array). In these two configurations, the recording unit 105 records the second dot pattern to be adjacent to one side of the first dot patterns, so that the defective discharge of the nozzles at one end of the predetermined nozzle array, which is a target for detecting, occurs at the center of the pattern as the recording omission. Further, when the recording unit 105 records the second dot pattern to be adjacent to both sides of the first dot pattern, the defective discharge at both ends of the predetermined nozzle array occurs at the center of the pattern as a recording omission. Therefore, when the recording unit 105 records the second dot pattern by using a nozzle array, which is different from the target nozzle array for detecting defective discharge, the recording unit 105 can properly record the second dot pattern at a position adjacent to both sides of the first dot pattern. However, even when the recording unit 105 records the second dot pattern to be adjacent to at least one side of the first dot pattern, the object of the present invention, i.e., defective discharge at the end of a nozzle array can be easily detected, can be attained. In addition, according to the present exemplary embodiment, when the recording unit 105 records both the first dot pattern and the second dot pattern by using the nozzle array, which is a target for detecting defective discharge, defective discharge at both ends of the nozzle array, which is a target for detecting defective discharge, can be easily detected by only two dot patterns.

The second exemplary embodiment is an example in which the present invention is applied to the head position adjustment processing. In the head position adjustment processing, a head position adjustment pattern is recorded, an optical sensor in a reading unit 104 reads the recorded head position adjustment pattern, and the reading unit 104 calculates a head position adjustment value. The same numerous symbols as the first exemplary embodiment are used for same configurations as the first exemplary embodiment, therefore descriptions of the configurations will be omitted. In addition, the head position adjustment processing is automatically performed when a recording apparatus is initially powered on. Further, a user can perform the head position adjustment processing at desired timing with his command via an operation unit 606.

Figure 5:
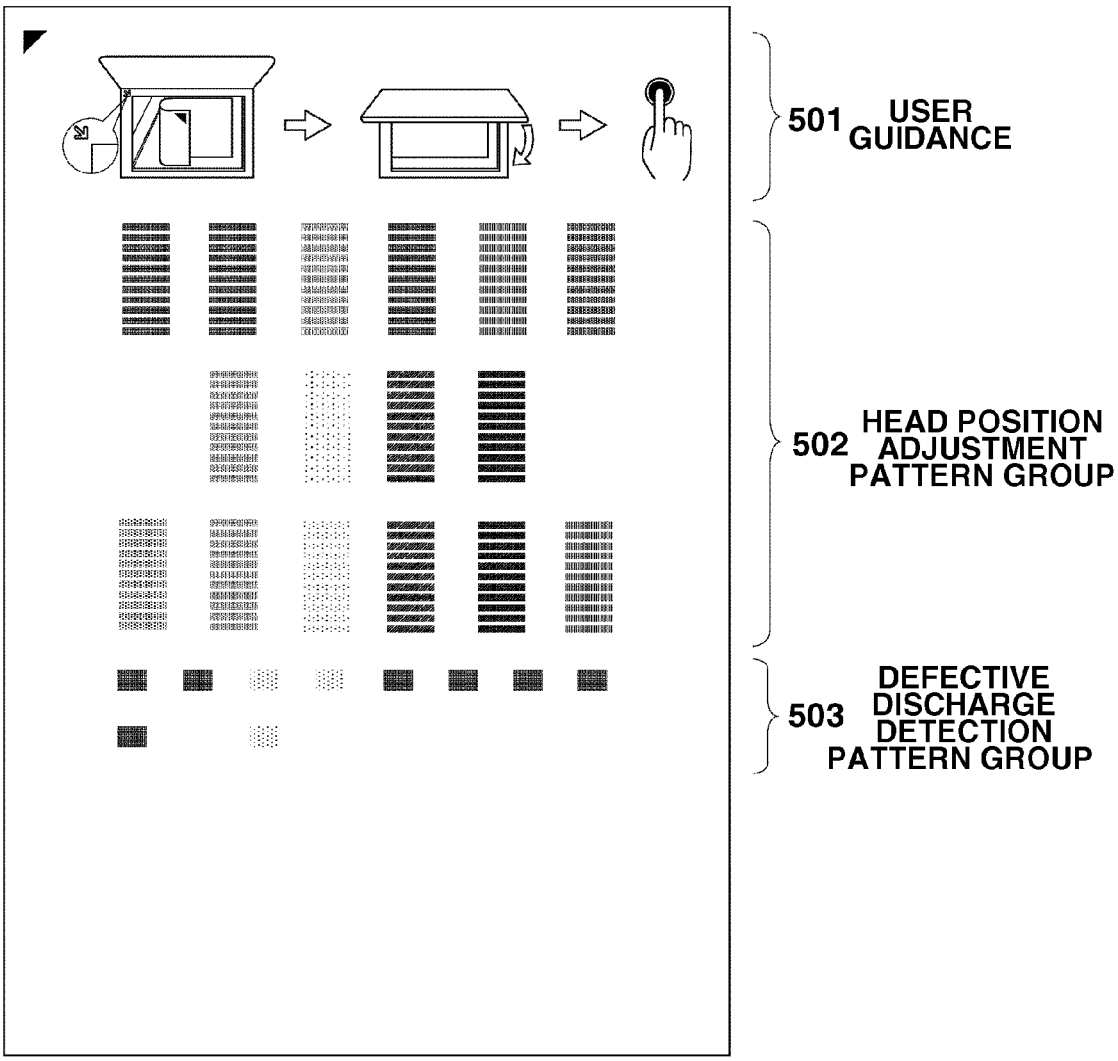
FIG. 5 illustrates a recording example of a defective discharge detection pattern group and a recording position adjustment pattern group.

FIG. 5 illustrates an example of a recording medium P on which a defective discharge detection pattern according to the present exemplary embodiment is recorded. On the recording medium P, a user guidance 501, which prompts a user to perform the head position adjustment processing, is recorded at a top, a head position adjustment pattern group 502 is recorded next to the user guidance 501, and a defective discharge detection pattern group 503 is recorded at a bottom. These are recorded by the recording head 1102.

Figure 8:
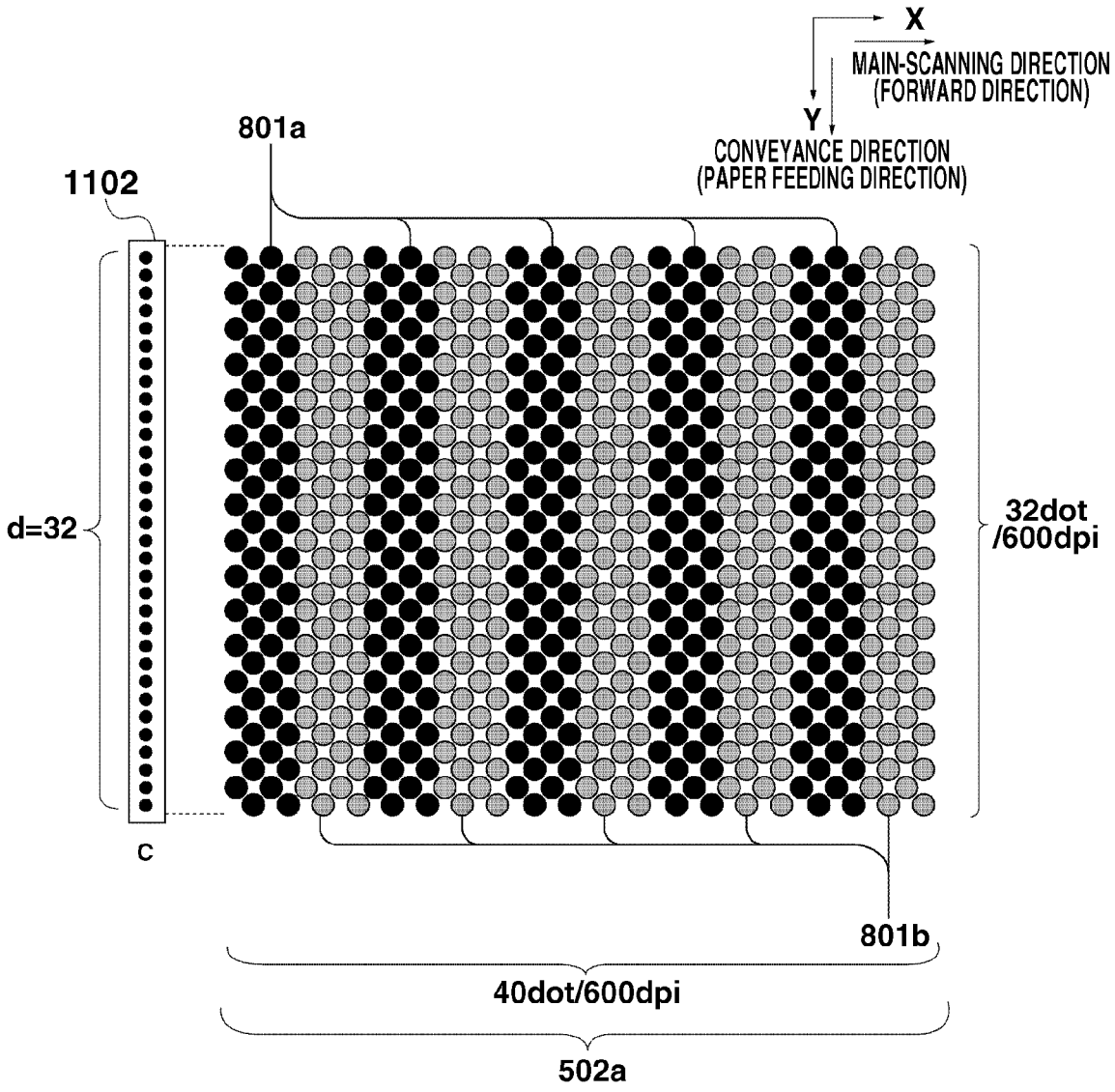
FIG. 8 illustrates a recording method of a recording position adjustment pattern of reciprocal adjustment.

FIG. 8 illustrates a reference pattern 502*a* of the head position adjustment pattern among the head position adjustment pattern group 502 in FIG. 5. The reference pattern 502*a* adjusts an impact position (recording position) of ink in forward scanning and backward scanning by a cyan array. In FIG. 8, dots 801*a* are recorded by the forward scanning, and dots 801*b* are recorded by the backward scanning. The entire pattern has a rectangular shape having a length of 40 dots with a recording resolution of 600 dpi in the x direction and a length of 32 dots with a nozzle resolution of 600 dpi in the y direction. A specific recording method is described as follows. In the forward scanning, the recording unit 105 records a checkered image, in which dots are recorded every other dot, by every four dots repeatedly five times. In this scanning, the recording resolution in the x direction is 600 dpi. Then, in the backward scanning, the recording unit 105 records the same checkered image as that in the forward scanning by every four dots repeatedly five times, so that the images in the forward scanning and the images in the backward scanning are recorded without spaces. The reference pattern 502*a* is formed by the images in the forward scanning and in the backward scanning, which are arranged without spaces and are not overlapping with each other. A deviation amount between the image in the forward scanning and the image in the backward scanning at this time is 0. Patterns having the deviation amount that varies in a range from −5 to +5 per 1 dot are recorded in addition to the reference pattern 502*a*. The reading unit 104 reads an optical characteristic (average luminance) of each recording position adjustment pattern, and detects a pattern indicating the lowest luminance. Based on the deviation amount when the pattern indicating the lowest luminance is recorded, CPU 600 can determine an adjustment value for adjusting a deviation of a recording position.

Figure 6:
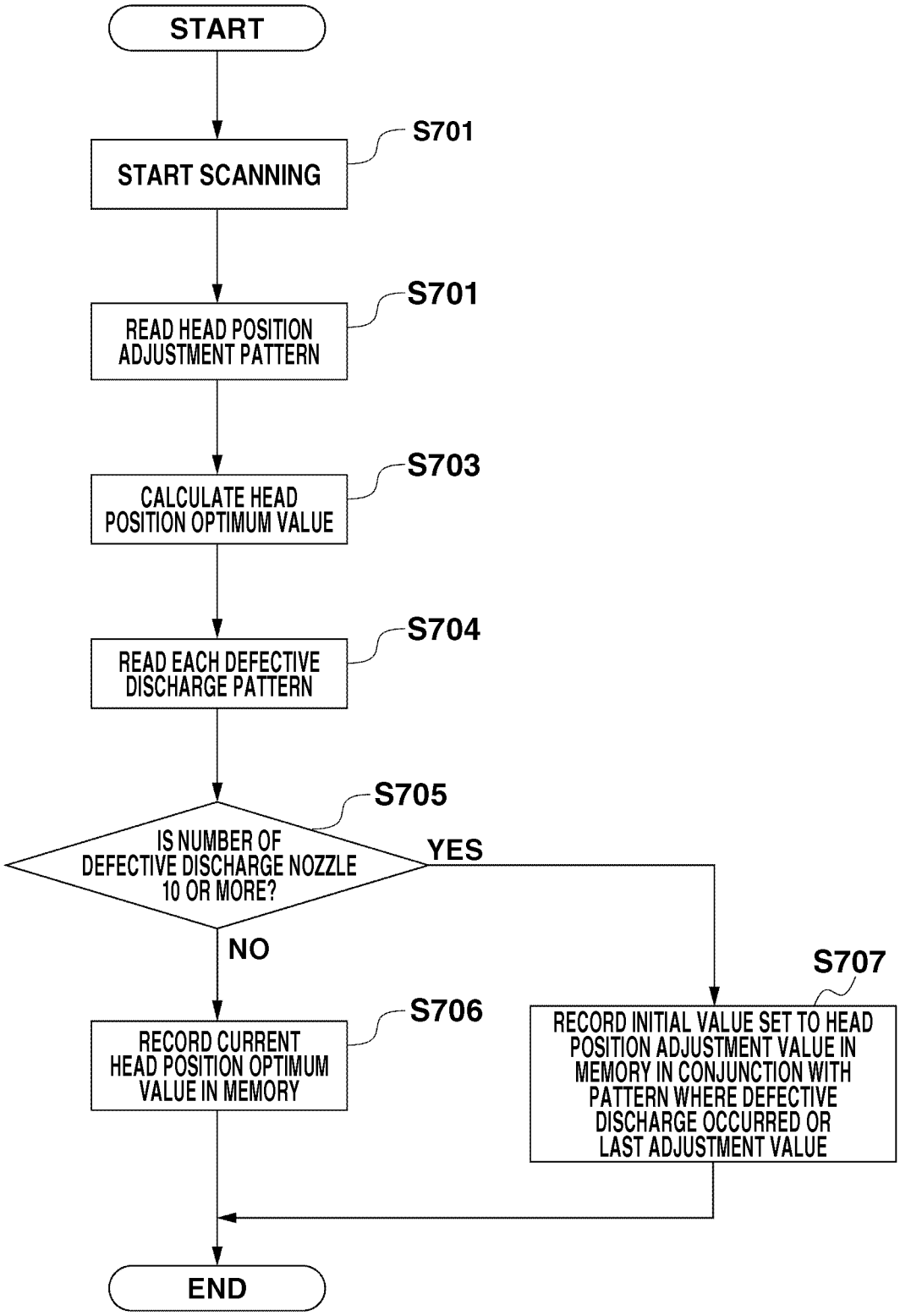
FIG. 6 is a flowchart illustrating a flow from start to end of head position adjustment processing.

FIG. 6 is a flowchart illustrating processing from the start of reading a recording medium to the end of the head position adjustment processing. A user opens a reading cover of the reading unit 104 of the MFP 100, and puts on a glass plate, a medium on which a pattern is recorded. The user closes the reading cover, and presses a start key provided at the operation unit 606. Then, in step S701, the reading unit 104 starts scanning of a recording medium. In addition, the number of effective elements of an optical sensor used for reading in the present exemplary embodiment is 300 dpi, which is equal to or lower than the number of effective recording elements of a recording head (D=600 dpi).

In step S702, when the reading unit 104 starts scanning the recording medium, the reading unit 104 reads the head position adjustment pattern group 502 (measurement of luminance of each pattern). The head position adjustment pattern group 502 includes head position adjustment patterns having various kinds of adjustment items, such as adjustment of a recording position according to inclination of a nozzle array and adjustment of a recording position between large and small nozzle arrays of cyan, in addition to the adjustment of a recording position in the forward scanning and the backward scanning (the reciprocal adjustment) with the cyan array illustrated in FIG. 8. In step S703, the CPU 600 calculates, for each head position adjustment item, an optimum head position adjustment value based on information related to the luminance of each head position adjustment pattern.

In step S704, the reading unit 104 reads the defective discharge detection pattern group 503 (measurement of luminance of each pattern). The defective discharge detection pattern group 503 of the present exemplary embodiment includes a plurality of defective discharge detection patterns corresponding to the nozzles that record each head position adjustment pattern included in the head position adjustment pattern group 502. For example, when the recording unit 105 records the head position adjustment pattern of the reciprocal adjustment using d=32 pieces of nozzles of the cyan array as illustrated in FIG. 8, the defective discharge detection pattern group 503 includes a defective discharge detection pattern 502*a* recorded by using d=32 pieces of the nozzles of the cyan array as illustrated in FIG. 7. Combination of the head position adjustment pattern and the defective discharge detection pattern will be described in detail below.

In step S705, the CPU 600 checks whether a cumulative number of defective discharge nozzles is equal to or larger than 10 with respect to each defective discharge detection pattern, based on the image data of the defective discharge detection pattern group 503 read in step S704. The cumulative number of 10 of the defective discharge nozzles is a threshold value indicating that adjustment of a head position may be in a trouble. In addition, the detection processing of the number of the defective discharge nozzle in the second exemplary embodiment is performed by the same processing as the first exemplary embodiment and the number of effective elements of an optical sensor is 300 dpi, which is lower than nozzle resolution of 600 dpi of the nozzle array.

When the nozzle array includes defective discharge nozzles, a slit-like recording omission occurs in an image even when the defective discharge nozzles are at the end of the nozzle array. Thus, in the output of the scanning result by the optical sensor, the luminance of the defective discharge portion becomes different from the luminance of the image portion as illustrated in FIG. 7B. The luminance of the part of the slit-like recording omission is 210 cd/m$^2$, which is the same luminance as the recording medium. When the cumulative number of the defective discharge nozzles is less than 10, the CPU 600 determines that it causes no problem if the head position adjustment value is determined based on the head position adjustment pattern formed by the nozzle group (position) that is a target for detecting. Then, in step S706, the CPU 600 records the head position adjustment value calculated in step S703 in the RAM 602, and the processing ends.

When the cumulative number of defective discharge nozzles is equal to or lager than 10, the deviation of the recording position could not be corrected exactly even when the CPU 600 determines the head position adjustment value based on the head position adjustment pattern formed by the nozzle group (position) that is a target for detecting. Therefore, in step S707, the CPU 600 does not use the head position adjustment value calculated in step S703 based on the head position adjustment pattern corresponding to the defective discharge detection pattern, but records, in the RAM 602, an initial value set in an apparatus main body or the last head position adjustment value, and the processing ends.

In the present exemplary embodiment, the recording unit 105 records the head position adjustment pattern group 502 in advance of the defective discharge detection pattern group 503. If the recording unit 105 records the defective discharge detection pattern group 503 in advance, a problem occurs when the defective discharge detection pattern group 503 is normally recorded, and then the ink is exhausted at a time of recording the head position adjustment group 502. More specifically, even through defective discharge of ink occurs in the head position adjustment pattern, the CPU 600 determines that the nozzle array does not include defective discharge, calculates the head position adjustment value based on the pattern including the defective discharge, and thus could perform the wrong adjustment of a head position. Therefore, in the present exemplary embodiment, after the recording unit 105 records the head position adjustment pattern group 502, the recording unit 105 records the defective discharge detection pattern group 503.

Accordingly, in the present exemplary embodiment, even when a nozzle array includes defective discharge nozzles at its end part, the defective discharge nozzle can be easily detected. Further, the CPU 600 executes the recording position adjustment processing after determining whether a defective discharge nozzle appears or not, so that the recording position is not adjusted with a wrong adjustment value.

Next, a combination of the head position adjustment pattern included in the head position adjustment pattern group 502 and the defective discharge detection pattern included in the defective discharge detection pattern group 503 will be described below, where the defective discharge detection pattern corresponds to the head position adjustment pattern. In addition, in the head position adjustment processing, it is not necessary to adjust the all adjustment items described below, but only a part of the adjustment items may be adjusted.

A modified exemplary embodiment of the reciprocal adjustment of the cyan array will be described. The modified exemplary embodiment is different from the patterns illustrated in FIGS. 7 and 8 in that the recording unit 105 records the head position adjustment pattern and the defective discharge detection pattern using a part of the nozzle array.

Figure 9A:
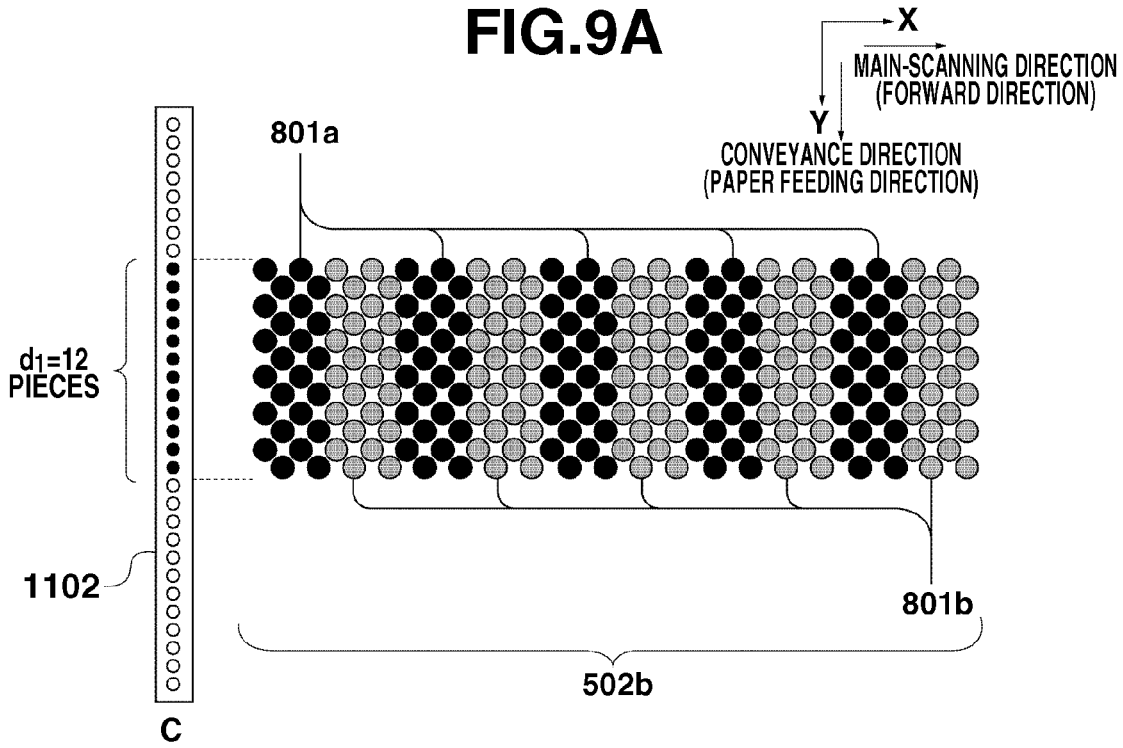
FIGS. 9A and 9B illustrate recording methods of a recording position adjustment pattern of a modified example of reciprocal adjustment.

FIG. 9 illustrates positions of nozzles to be used for the head position adjustment pattern and the defective discharge detection pattern according to the present modified exemplary embodiment. FIG. 9A illustrates the positions of nozzles to be used for the reference pattern 502*b* of the head position adjustment pattern. The recording unit 105 records the reference pattern 502*b* using a nozzle group d1 (continuous 12 nozzles at a center of a nozzle array) that is a part of the cyan array. The entire pattern has a rectangular shape having a length of 40 dots with recording resolution of 600 dpi in the x direction and a length of 12 dots with nozzle resolution of 600 dpi in the y direction. In a pattern recording method, the recording unit 105 records the pattern using a condition similar to the recording of the head position adjustment pattern in FIG. 8, except that the head position adjustment pattern and the positions of use nozzles are different. More specifically, in a forward scanning, a checkered image in which dots are recorded every other dot with recording resolution of 600 dpi in the x direction, is recorded by every four dots repeatedly five times. In a backward scanning, the same checkered image is recorded five times by every four dots. Accordingly, the image in the forward scanning and the image in the backward scanning are recorded without spaces.

Figure 9B:
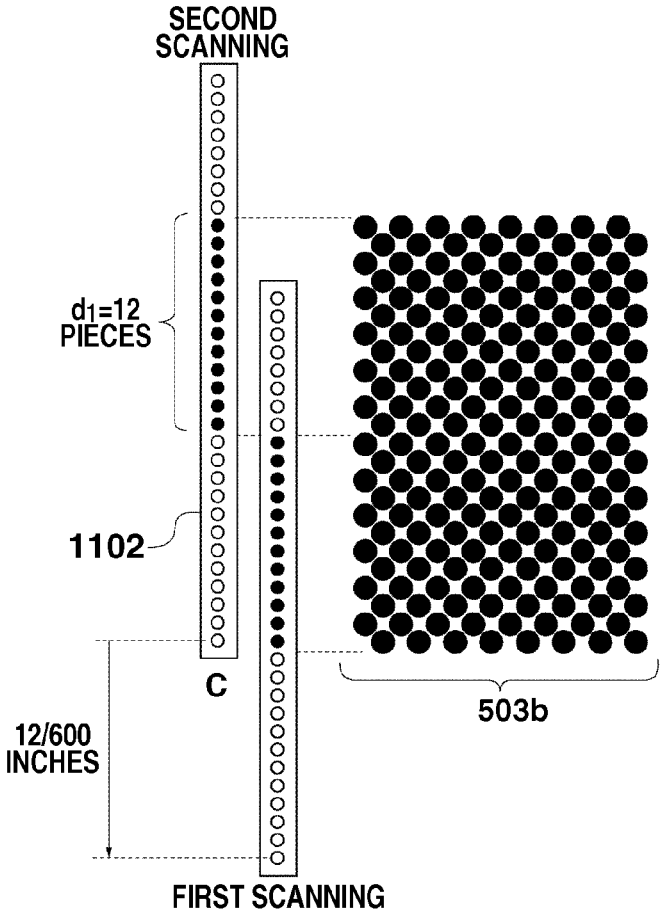

FIG. 9B illustrates a defective discharge detection pattern 503*b*. The defective discharge detection pattern 503*b* is recorded by using the same nozzle group d1 as the head position adjustment pattern in FIG. 9A. A pattern recording method has the same conditions as the recording method of the defective discharge detection pattern 503*a* in FIG. 7 except that the positions of use nozzles are different. More specifically, the recording unit 105 scans the recording head 1102 along the x direction, and records a solid image of 16 dots with recording resolution of 600 dpi in the x direction using the nozzle group d1 of the cyan arrays. After the first recording scan ends, the recording unit 105 feeds a paper in the y direction by a width of the nozzle group d1 (12 dots/600 inches). Then, the recording unit 105 scans the recording head 1102 in the same direction as the first scanning, and records the same solid image as the image recorded in the first scanning to be adjacent to the previous image. In the image of the second scanning, the recording unit 105 starts recording at the same position in the x direction as the previous image, and the image has a same recording width as the previous image, i.e., 16 dots with the recording resolution of 600 dpi.

Accordingly, in the defective discharge detection pattern of the present exemplary embodiment, a user can detect occurrence of defective discharge by checking whether a recording omission occurs at the center of the pattern, and thus can easily detect the defective discharge. Further, when the pattern for reciprocal adjustment is formed by using apart the nozzle group of the nozzle array (the nozzle group d1), the defective discharge detection pattern is formed by using only the nozzle group d1, so that the user can reduce useless consumption of ink.

Figure 10A:
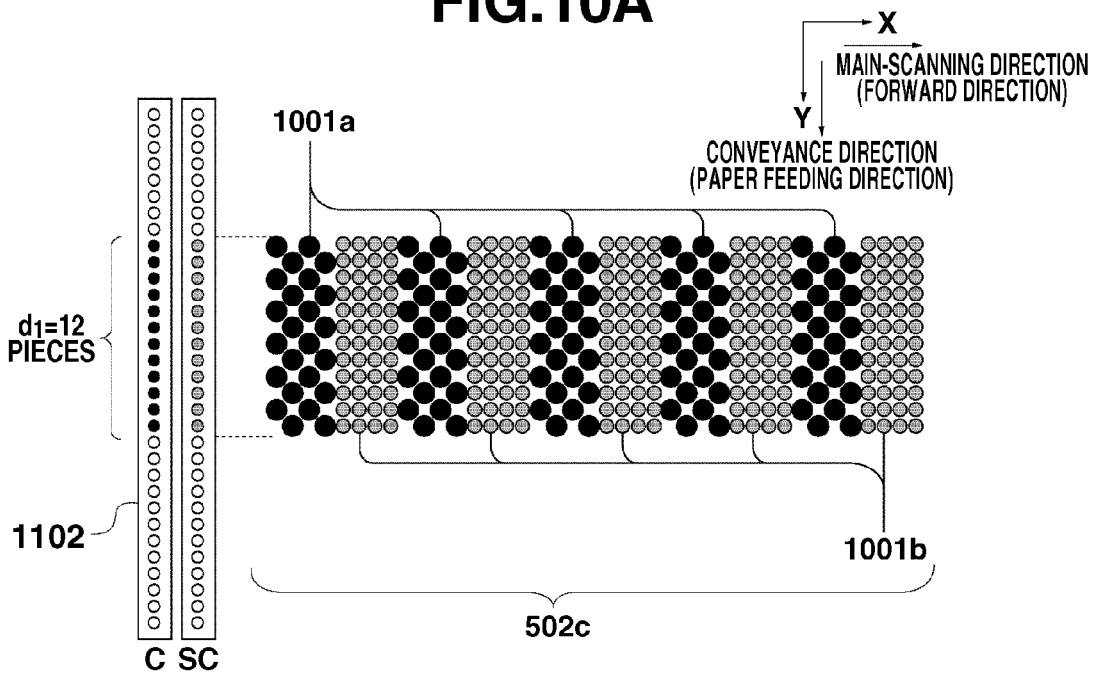
FIGS. 10A and 10B illustrate recording methods of a recording position adjustment pattern and a defective discharge detection pattern of adjustment between large and small nozzle arrays.

FIG. 10 illustrates positions of nozzles to be used for a head position adjustment pattern and a defective discharge detection pattern according to an adjustment of large and small nozzle arrays. The head position adjustment pattern 502*c* in FIG. 10A is a reference pattern for adjusting the recording position between a cyan array C and a small cyan array SC of the recording head 1102. This pattern is recorded by the nozzle groups d1 of the cyan array C and the small cyan array SC (continuous 12 nozzles at the center of each nozzle array), and the entire head position adjustment pattern 502*c* has a rectangular shape having a length of 40 dots with recording resolution of 600 dpi in the x direction and a length of 12 dots with nozzle resolution of 600 dpi in the y direction. In the head position adjustment pattern 502*c*, dots 1001*a* indicate dots recorded by the cyan array C, and dots 1001*b* indicate dots recorded by the small cyan array SC. The amount of discharges of ink of 1 dot discharged from the cyan array C is 5 picoliters, and the amount of discharges of ink of 1 dot discharged from the small cyan array SC is 2 picoliters.

A recording method of the reference pattern 502*c* of the head position adjustment pattern will be described. In the forward scanning, the recording unit 105 records a checkered image, in which dots are recorded every other dot, by every four dots repeatedly five times with the nozzle group d1 of the cyan array C. At this time, the recording resolution in the x direction is 600 dpi. In the similar forward scanning, the recording unit 105 records a solid image by every four dots repeatedly five times with the nozzle group d1 of the small cyan array SC. Thus, the image of the cyan array C and the image of the small cyan array SC are recorded without spaces. At this time, both the cyan array C and the small cyan array SC have recording resolution of 600 dpi in the x direction. Accordingly, in the present exemplary embodiment, the pattern recorded by the cyan array C is the checkered image, and the image recorded by the small cyan array SC is the solid image, so that these patterns can be detected with approximately equal luminance.

Figure 10B:
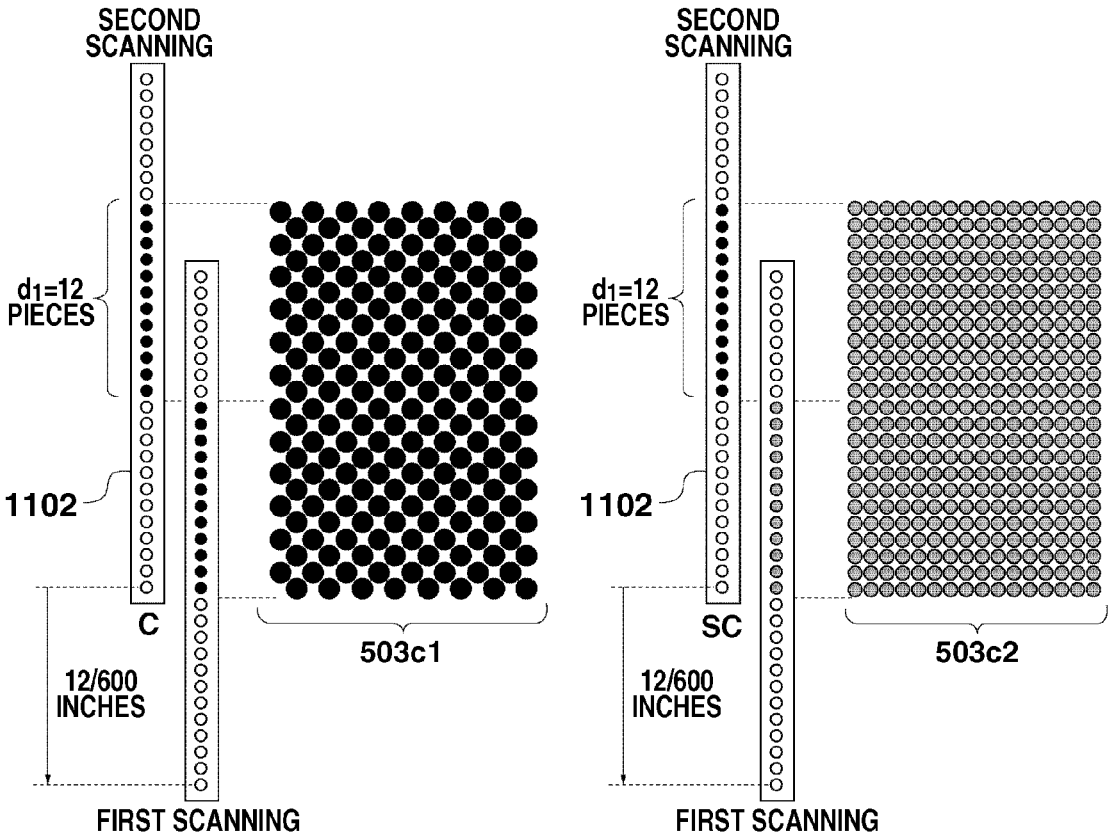

Defective discharge detections patterns 503*c*1 and 503*c*2 in FIG. 10B are a defective discharge detection pattern of the cyan array C and a defective discharge detection test pattern of the small cyan array SC. Each pattern is recorded by the same nozzle group d1 of cyan array C, which is used in the head position adjustment pattern 502*d*. The recording unit 105 scans for a defective discharge detection pattern 503*d*1 of the cyan array C with the recording head 1102 along the x direction, and records a checkered image in the x direction by 16 dots with recording resolution of 600 dpi with the nozzle group d1 of the cyan array C. The checkered image is similar to the image recorded by the cyan array C in the head position adjustment pattern 502*c*. After the first record scanning ends, the recording unit 105 feeds a paper by a width of the nozzle group d1 (12 dots/600 inches) in the y direction. Then, the recording unit 105 scans with the recording head 1102 in the same direction as the first scanning, and records the same checkered image as the image recorded in the first scanning to be adjacent to the previous image. With respect to the image recorded in this scanning, the recording unit 105 starts recording from the same position in the x direction as the previous image, and a recording width is the same as that of the previous image, i.e., 16 dots with the recording resolution of 600 dpi.

Further, the recording unit 105 scans for a defective discharge detection pattern 503*d*2 of the small cyan array SC with the recording head 1102 along the x direction, and records a solid image in the x direction by 16 dots with recording resolution of 600 dpi with the nozzle group d1 of the small cyan array SC. The solid image is the same as the image recorded by the small cyan array SC in the head position adjustment pattern 502*d*. After the first record scanning ends, the recording unit 105 feeds a paper by a width of the nozzle group d1 (12 dots/600 inches) in the y direction. Then, the recording unit 105 scans with the recording head 1102 in the same direction as the first scanning, and records the same solid image as the image recorded in the first scanning with the nozzle group d1 of the small cyan array SC to be adjacent to the previous image. With respect to the image recorded in this scanning, the recording unit 105 starts recording from the same position in the x direction as the previous image, and a recording width is the same as that of the previous image, i.e., 16 dots with the recording resolution of 600 dpi.

Accordingly, when the recording unit 105 forms the pattern for the adjustment between large and small nozzle arrays using a part of the nozzle array (the nozzle group d1), the recording unit 105 forms the defective discharge detection pattern with only the same nozzle group d1, so that useless consumption of ink can be reduced. Further, in the defective discharge detection patterns 503*c*1 and 503*c*2, a user can detect occurrence of defective discharges by determining whether recording omissions occurs at the center of the patterns, so that the defective discharges can be easily detected.

In addition, the defective discharge detection pattern 503*b* in FIG. 9B and the defective discharge detection pattern 503*c*1 in FIG. 10B are the same. Therefore, when a user performs both the reciprocal adjustments using the nozzle group d1 of the cyan array C and the adjustment between large and small nozzles using the nozzle groups d1 of the cyan array C and the small cyan array SC, the number of the defective discharge detection pattern of the nozzle group d1 of the cyan array C can be only one. Further, when a user performs both the reciprocal adjustment using the entire nozzles of the cyan array C and the adjustment between large and small nozzles using the nozzle groups d1 of the cyan array C and the small cyan array SC, the user can detect the defective discharge of the entire nozzles by forming the detection pattern 503*a* using the entire nozzles of the cyan array C. In such a case, it is not necessary to form the defective discharge detection pattern 503*c*1 of the nozzle group d1.

Figure 11A:
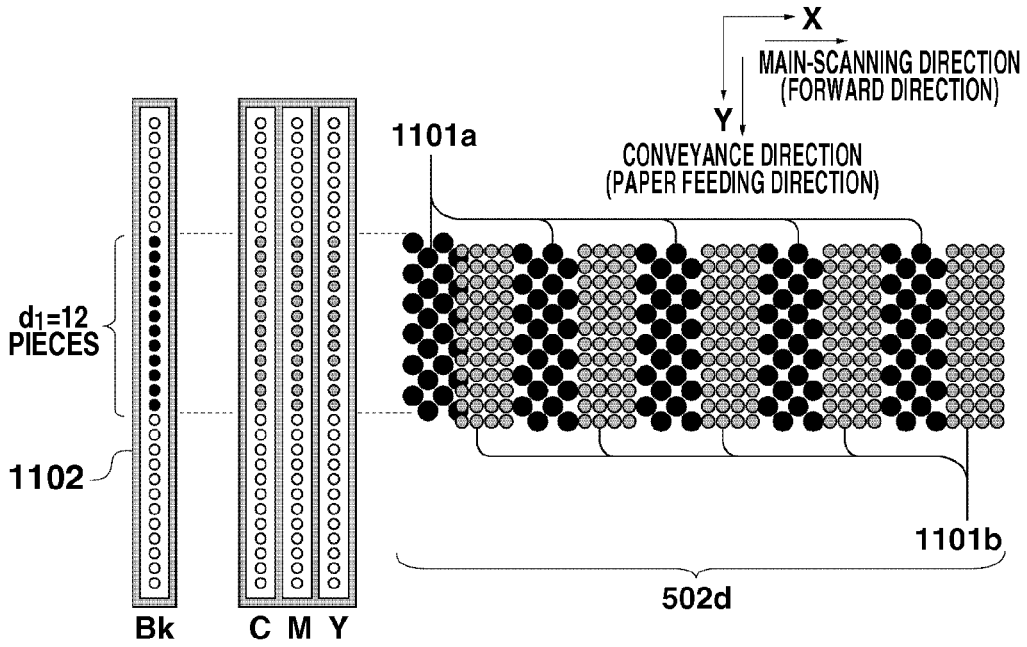
FIGS. 11A and 11B illustrate recording methods of a recording position adjustment pattern and a defective discharge detection pattern of adjustment between black and color.

FIG. 11 illustrates positions of nozzles to be used for the head position adjustment pattern and the defective discharge detection pattern according to the adjustment between black and color. A nozzle array of black and nozzle arrays of color (cyan, magenta, and yellow) are arranged on different recording heads. A head position adjustment pattern for the adjustment between black and color is used to adjust an impact position between the recording heads, and is recorded by each nozzle group d1 of the nozzle arrays of black, cyan, magenta, and yellow (continuous twelve nozzles at the center of each nozzle array). Dots 1101*a* in the pattern indicates dots recorded by the black array Bk, and dots 1101*b* indicates dots recorded by the color arrays (C, M, and Y).

In the reference pattern 502*d* of the head position adjustment pattern, in the forward scanning, the recording unit 105 records a checkered image, in which dots are recorded every other dot, by every four dots repeatedly five times with the nozzle group d1 of the black array Bk. In this scanning, recording resolution in the x direction is 600 dpi. In the same forward scanning, the recording unit 105 records a solid image including tertiary colors by every four dots repeatedly five times with the each nozzle group d1 of the cyan array C, the magenta array M, and the yellow array Y, so that the image of the black array Bk and the image of the color arrays (C, M, Y) are recorded without spaces. In this scanning, the recording resolutions of the black array Bk and the color arrays (C, M, Y) in the x direction are 600 dpi. Accordingly, in the present exemplary embodiment, the pattern recorded by the black array Bk is a checkered image, and the image recorded by the color nozzle arrays is a solid image including tertiary colors, so that these patterns can be detected at approximately equal luminance.

Figure 11B:
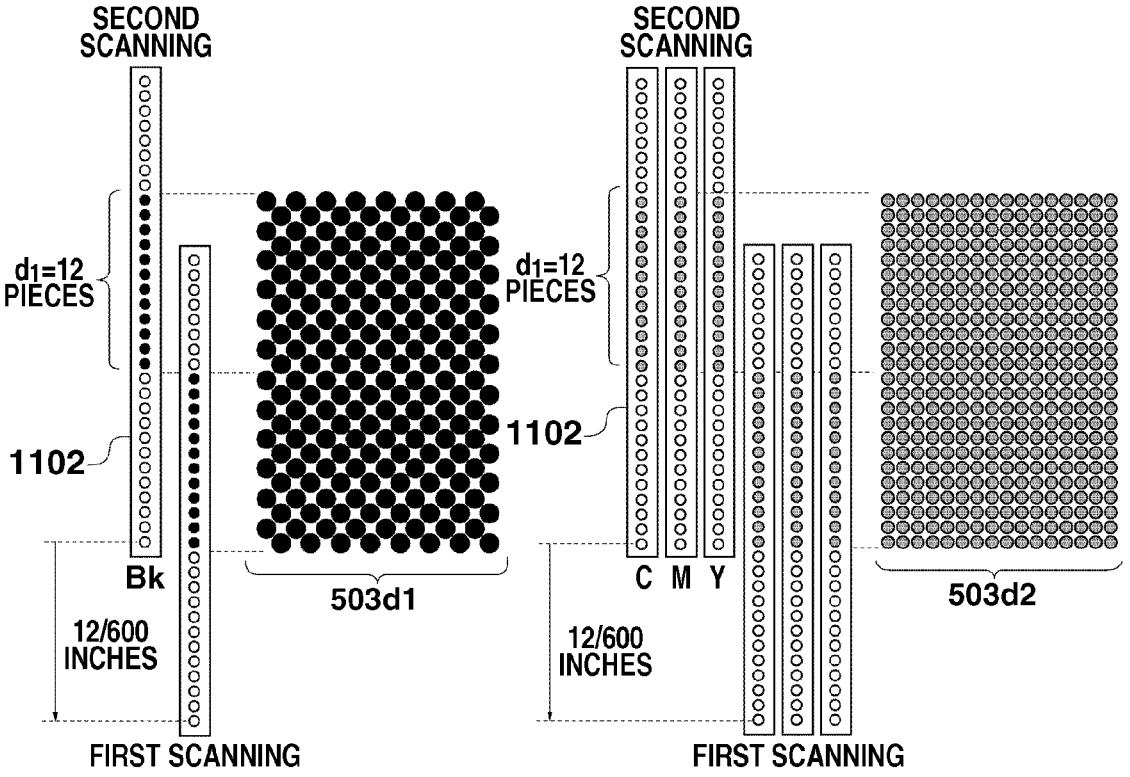

In FIG. 11B, the defective discharge detection pattern 503*d*1 is a detection pattern of the black array, and the defective discharge detection pattern 503*d*2 is a detection test pattern of the cyan array C, the magenta array M, and the yellow array Y. Each pattern is detected by the nozzle group d1, which is the same nozzle group d1 of the head position adjustment pattern 502*d*. The recording unit 105 scans for the defective discharge detection pattern 503*d*1 of the black array Bk with the recording head 1102 along the x direction, and records a checkered image in the x direction of 16 dots with recording resolution of 600 dpi with the nozzle group d1 of the black array Bk. The checkered image is similar to the image recorded by the black array Bk in the head position adjustment pattern 502*d*. After the first record scanning ends, the recording unit 105 feeds a paper by a width of the nozzle group d1 (12 dots/600 inches) in the y direction. Then, the recording unit 105 scans with the recording head 1102 in the same direction as the first scanning, and records the checkered image that is the same image as the previous image recorded by the first scanning, to be adjacent to the previous image by the nozzle group d1 of the black array Bk. With respect to the image recorded by this scanning, the recording unit 105 starts recording from the same position in the x direction as the previous image, and a recording width in the scanning is same as that of the previous image, i.e., 16 dots with the recording resolution of 600 dpi.

In the recording of the defective discharge detection pattern 503*d*2 of the cyan array C, the magenta array M, and the yellow array Y, the recording unit 105 scans with the recording head 1102 along the x direction, and records a solid image of 16 dots including tertiary colors in the x direction by with recording resolution of 600 dpi with 12 nozzles in each nozzle array. The solid image is the same image as the previous image recorded by the cyan array C, the magenta array M, and the yellow array Y in the head position adjustment pattern 502*d*. After the first recording ends, the recording unit 105 feeds a paper by a width of the nozzle group d1 (12 dots/600 inches) in the y direction. Then, the recording unit 105 scans with the recording head 1102 in the same direction as the first scanning, and records a solid image including tertiary colors, which is the same image as the previous image recorded by the first scanning, with the nozzle groups d1 of the cyan array M, the magenta array M, and the yellow array Y, to be adjacent to the previous image. In recording the image in this scanning, the recording unit 105 starts the recording from the same position in the x direction as the previous image, and a recording width is the same as the recording width of the previous image, that is, 16 dots with the recording resolution of 600 dpi.

Accordingly, when the recording unit 105 forms the pattern for adjustment between black and color using a part of the nozzle array (the nozzle group d1), useless consumption of ink can be reduced by forming the defective discharge detection pattern using only the nozzle group d1. Further, in the defective discharge detection pattern 503*d*, a user can detect occurrence of the defective discharges by determining whether recording omissions occur at the center of the pattern, so that the defective discharge can be easily detected.

Figure 12A:
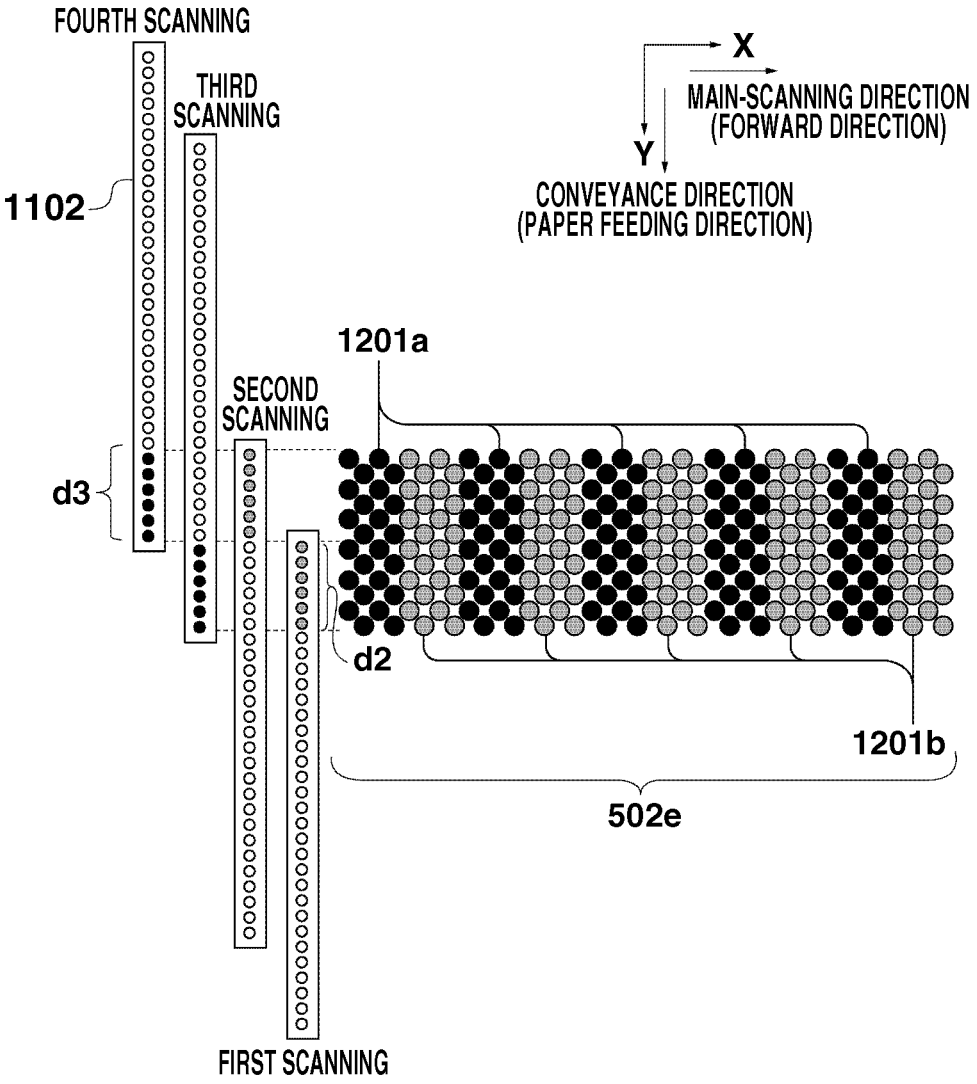
FIGS. 12A and 12B illustrate recording methods of a recording position adjustment pattern and a defective discharge detection pattern of inclination adjustment.

FIG. 12 illustrates position of nozzles to be used for the head position adjustment pattern and the defective discharge detection pattern to adjust inclination for adjusting an impact position (recording position) with an inclination θ of a recording head (nozzle array). The reference pattern 502*e* of the head position adjustment pattern in FIG. 12A is recorded by using a nozzle group d2 at an upper end of the cyan array C of the recording head and a nozzle group d3 at a lower end of the cyan array C. The nozzle group d2 includes six nozzles from the end on the upstream side of the cyan array C, and the nozzle group d3 includes six nozzles from the end on the downstream side of the cyan array C (upper end in FIG. 12). The entire pattern has a rectangular shape having a length of 40 dots with recording resolution of 600 dpi in the x direction and a length of 12 dots with nozzle resolution of 600 dpi in the y direction. In FIG. 12, dots 1201*a* in the pattern indicates dots recorded by the nozzle group d2 on the upstream side of the cyan array C, and dots 1201*b* indicates dots recorded by the nozzle group d3 on the downstream side of the cyan array C.

In the reference pattern 502*e*, in the forward scanning, the recording unit 105 records a checkered image, in which dots are recorded every other dot, by every four dots repeatedly five times with the nozzle group d2 of the cyan array C. Then, the recording unit 105 feeds a paper in the y direction by a width corresponding to the nozzle group d2 (6 dots/600 inches). Further, the recording unit 105 records a checkered image, in which dots are recorded every other dot, by every four dots repeatedly five times with the nozzle group d2, so that the checkered image of the nozzle group d2 on the upstream side is completed. Then, the recording unit 10 feeds a paper by 20 dots/600 inches in the y direction, and records a checkered image, in which dots are recorded every other dot, by every four dots repeatedly five times with the nozzle group d3. Then, the recording unit 10 feeds the paper in the y direction by a width corresponding to the nozzle group d3 (6 dots/600 inches), and records a checkered image, in which dots are recorded every other dot, by every four dots repeatedly five times with the nozzle group d3 on the downstream side, so that the checkered image of the nozzle group d3 on the downstream side is completed.

Figure 12B:
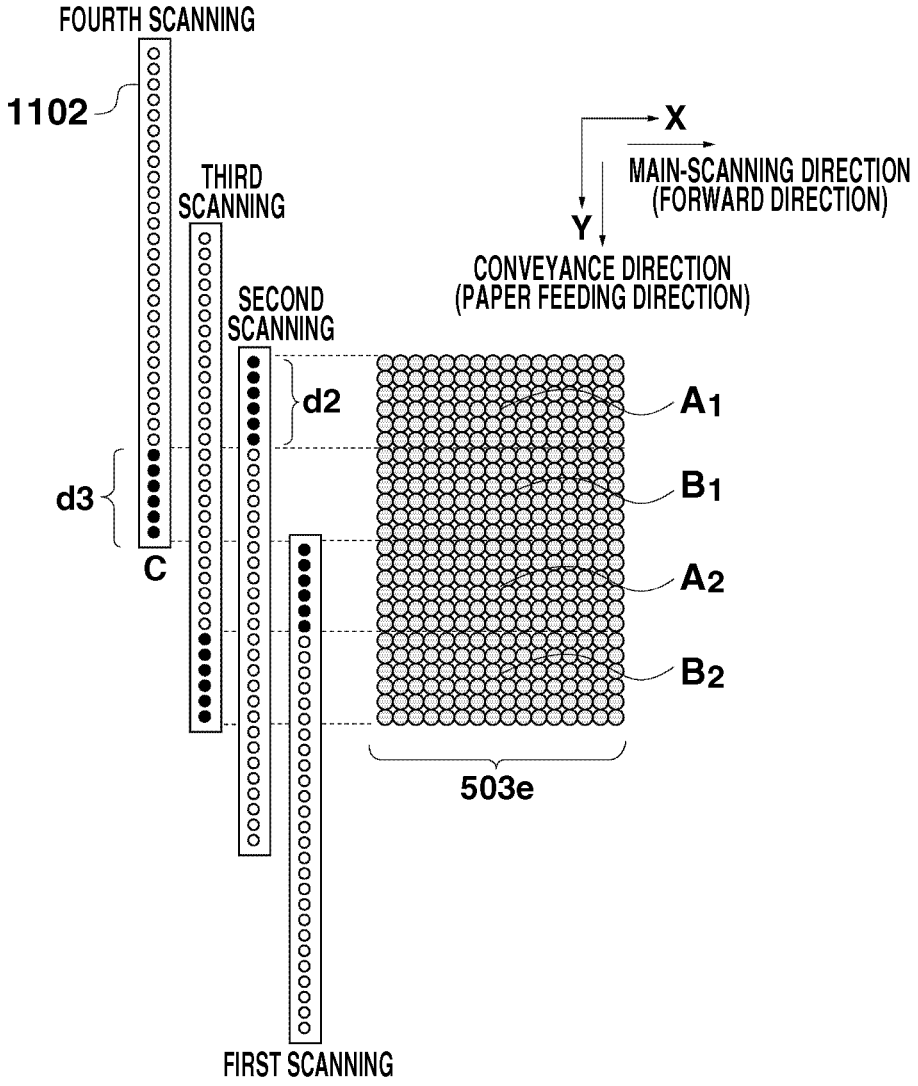

A defective discharge detection pattern 503*e* in FIG. 12B is recorded by using the nozzle groups d2 and d3 of the cyan array, like the head position adjustment pattern 502*e* in FIG. 12A. With respect to the defective discharge detection pattern 503*e*, the recording unit 105 scans with the recording head 1102 in the x direction, and records an image A2 with the nozzle group d2 on the upstream side. Then, the recording unit 105 feeds a paper in the y direction by 12 dots/600 inches, and records an image A1 with the nozzle group d2 on the upstream side.

Then, the recording unit 105 feeds the paper in the y direction by 6 dots/600 inches, and records an image B2 to be adjacent to an image B1 with the nozzle group d3 on the downstream side. After the recording unit 105 feeds the paper in the y direction by 6 dots/600 inches, the recording unit 105 records the image B1 between the image A1 and the image A2 with the nozzle group d3 on the downstream side. The entire pattern completed by this recording has a rectangular shape having a length of 16 dots with recording resolution of 600 dpi in the x direction and a length of 12 dots with nozzle resolution of 600 dpi in the y direction.

Accordingly, when the recording unit 105 forms the pattern for the adjustment of inclination using a part of the nozzle array (nozzle groups d2 and d3), the recording unit 105 forms the defective discharge detection pattern with only the nozzle groups d2 and d3, so that useless consumption of ink can be reduced. Further, in the defective discharge detection pattern 503*e*, a user can detects occurrence of defective discharges by determining whether recording omissions occur at the center of the pattern, so that the user can easily detect the defective discharge.

In addition, the defective discharge detection pattern 503*e* is not restricted to the aforementioned configuration. The defective discharge detection pattern can be a pattern recording the image B1, the image A1, the image B2, and the image A2 in this order along the y direction, a pattern recording the image B1, the image B2, the image A1, and the image A2 in this order along the y direction, or a pattern recording the image A1, the image A2, the image B1, and the image B2 in this order along the y direction. Further, the defective discharge detection pattern can be a pattern that records only the image A1 and the image B1 to reduce a reading area of an optical sensor. In any exemplary embodiments, the defective discharge detection pattern 503*e* can be formed by using a nozzle group used in the head position adjustment pattern 502*e*.

Accordingly, by executing the recording position adjustment after determining whether defective discharge nozzles occur or not, a recording apparatus can avoid adjustment of a recording position with an incorrect adjustment value. As for the defective discharge detection pattern, the CPU 600 adopts the pattern configured to record the first dot pattern (image) by predetermined nozzles, which is a target for detecting defective discharge, and to record the second dot pattern at a position adjacent to the first dot pattern in the paper feeding direction. The first dot pattern may be a checkered image other than the solid image as long as the pattern is designed to enable detection of defective discharge.

The second dot pattern may be recorded by nozzles that are different from the nozzles recording the first dot pattern. For example, in the present exemplary embodiment, the second dot pattern may be recorded by using a nozzle array in a part of the cyan array, or a nozzle array other than the cyan array (e.g., a magenta array). In these two configurations, when the second dot pattern is recorded to be adjacent to one of the first dot patterns, the defective discharge of a nozzle at one end of the predetermined nozzle array, which is a target for detection, occurs as a recording omission at the center of the pattern. Further, when the second dot pattern is recorded to be adjacent to both sides of the first dot patterns, the defective discharges of nozzles at both ends of the predetermined nozzle array occur as recording omissions at the center of the pattern.

Therefore, when the recording unit 105 records the second dot pattern with a nozzle array that is different from the nozzle array that is a target for detecting defective discharge, it is preferable that the second dot pattern is recorded at a position that is adjacent to both the first dot patterns. However, even when the second dot pattern is recorded to be adjacent to at least one side of the first dot patterns, the defective discharge at an end of a nozzle array can be detected easily, so that the objective of the present invention can be attained. Further, when the recording unit 105 records the defective discharge detection pattern with the cyan array and the magenta array, it is preferable that pattern signals (luminance) read by the reading unit 104 are detected to be an approximately equal value both in a pattern of the cyan array and in a pattern of the magenta array.

In addition, like the present exemplary embodiment, when the recording unit 105 records both the first dot pattern and the second dot pattern with the nozzle array, which is a target for detecting defective discharge, the defective discharge can be easily detected using only two dot patterns regarding both ends of nozzle array, which is a target for detecting defective discharge.

In the third exemplary embodiment, the present invention is applied to head position adjustment processing of manual selection. In the head position adjustment processing, the apparatus records a head position adjustment pattern, and a user visually determines a head position adjustment value based on the recorded head position adjustment pattern. The components already described in the first and second exemplary embodiments are denoted by the same numerous symbols, and their descriptions will be omitted.

FIG. 13 illustrates a manual selection pattern by which a user visually determines the head position adjustment pattern. In the present exemplary embodiment, the recording unit 105 records, by using a recording head 1102, a head position adjustment pattern group (for rough adjustment) 504 on a first recording medium, and records a head position adjustment pattern group (for fine adjustment) 505 on a second recording medium.

A user visually selects a pattern, in which a head position is most suitable, among head position adjustment patterns of each head position adjustment item A to Y. Then, the user inputs the number corresponding to the selected pattern by an operation unit 606 of MFP 100, or inputs by an operation unit in a host apparatus (not illustrated). The input information is transmitted to MFP 100 via an interface, and CPU 600 in the control unit records the head position adjustment value in RAM 602. In the present exemplary embodiment, the reciprocal adjustment is performed by each nozzle array of magenta, black, small cyan, and a small magenta, in addition to the cyan array. The adjustment between large and small nozzles is performed between large and small nozzles of a magenta array and a small magenta array, other than the adjustment between the cyan array and the small cyan array. In the adjustment between back and color, small color arrays (SC, SM, SY) are provided on a recording head different from the recording head of the black array and the color arrays, and an adjustment between the black array and the small color arrays (SC, SM, SY) is performed. Furthermore, in the adjustment of inclination, CPU 600 performs an adjustment of inclination of a black array provided on a recording head that is different from the recording head of the cyan array, other than the aforementioned cyan array.

In the head position adjustment, there are some adjustment items requiring high accuracy. Thus, a user determines a rough adjustment value using a head position adjustment pattern group 504 (for rough adjustment) in a first recording, and determines, based on the rough adjustment value, a final adjustment value using the head position adjustment pattern group 505 (for fine adjustment) in a second recording. Accordingly, the number of the manual selection pattern becomes two or more. By contrast, in an automatic selection pattern illustrated in FIG. 5, the optical sensor reads each head position adjustment pattern and the head position adjustment pattern is acquired from the read luminance of each pattern. Thus, in the automatic selection pattern, there is no necessity to record the head position adjustment pattern group for fine adjustment such as the second recording in FIG. 13.

The head position adjustment pattern group 504 (for rough adjustment) in FIG. 13 and the head position adjustment group 502 in FIG. 5 have same pattern configurations for head position adjustment, as to the reciprocal adjustment, the adjustment between large and small nozzle arrays, and the adjustment of inclination. Further, as to a size of each head position adjustment pattern, the head position adjustment pattern group 504 (for rough adjustment) has a size of horizontally/vertically n×m times (n, m≥1) of each pattern of the head position adjustment pattern group 502 so that a user can easily determine. However, the position of each pattern in the pattern group 504 recorded on the recording medium is same as the patterns in pattern group 502 with respect to the main scanning direction of the recording head. In other words, to fix a distance between the recording medium and the recording head, the head position adjustment pattern is constantly recorded on a rib of a platen, which is arranged at a position opposite to the recording head and supports the recording medium.

Accordingly, in the third exemplary embodiment, two manual selection patterns are recorded, and a defective discharge detection pattern group is recorded on a third recording medium. When the defective discharge detection pattern group includes a pattern having a slit-like recording omission, the CPU 600 does not store, in RAM 602, an adjustment value of the head position adjustment pattern recorded by the nozzle group of the defective discharge detection pattern having the slit-like recording omission.

According to the above exemplary embodiments, when an error occurs in the paper feeding in the y direction, and a feeding amount is small, a part of the test pattern overlaps with each other. In such a case, an output value of luminance at the overlapping part is detected to be a different value from the luminance of the other part, and has a waveform stepping away from luminance of the recording medium. By contrast, when the feeding amount is large, a space is generated at a part of the test pattern, and a slit-like recording omission occurs, so that an output value of luminance of the space is detected having a waveform close to the recording medium. In any cases, if the amount of feeding error does not reach an equivalent to successive arbitrary number of defective discharge nozzles, the effectiveness of the present invention can be acquired.

The reading unit 104 reads and detects defective discharges with luminance (cd/m2), but the reading unit 104 can detect the defective discharges with an index other than the luminance. For example, the index can be a color specification system of L*a*b and an optical density (OD). In this case, in the pattern of cyan and the pattern of magenta, an arrangement of dots is adjusted so that they have same L*a*b value or same optical density. In any cases, at a time of reading by a sensor, when a nozzle array does not include a defective discharge nozzle, it is preferable that dots of the defective discharge detection pattern are arranged to be detectable with a reading value that is approximately equal to an image of a nozzle array that is a target for detecting.

In the aforementioned exemplary embodiments, the head position adjustment pattern group 502 and the defective discharge detection pattern group 503 are recorded on the same recording medium. However, the head position adjustment pattern group 502 and the defective discharge detection pattern group 503 may be recorded on different recording mediums. Further, in the aforementioned exemplary embodiments, MFP 100 integrating the recording unit 105 and the reading unit 104 is used. However, a recording system may include the recording unit 105 and the reading unit 104 as separate apparatuses.

In the second and third exemplary embodiments, the defective discharge detection pattern group 503 is recorded together with the head position adjustment pattern group 502. However, the defective discharge detection pattern group 503 may be recorded together with the other test pattern. For example, in an inkjet recording apparatus, a pattern group for adjusting the feeding amount of a recording medium, and a pattern group for adjusting drive control for discharging ink from a recording head may be applied to the present invention. In any case, the defective discharge detection pattern of the present invention can be widely applied to embodiments recording together with a gradation test pattern in which problems occur in adjustment of a recording apparatus main body when defective discharge occurs.

While the present invention has been described with reference to exemplary embodiments, it is to be understood that the invention is not limited to the disclosed exemplary embodiments. The scope of the following claims is to be accorded the broadest interpretation to encompass all modifications, equivalent structures, and functions.

This application claims priority from Japanese Patent Application No. 2009-155671 filed Jun. 30, 2009, which is hereby incorporated by reference herein in its entirety.

What is claimed is:

1. A method for recording with a recording head, wherein the recording head includes a nozzle array having a plurality of nozzles for discharging ink arranged in a predetermined direction and performs reciprocating movement in a scanning direction crossing the predetermined direction, the method comprising:

performing first recording for recording a first dot pattern on a recording medium by driving a nozzle group including a series of some nozzles, but not all of the nozzles, among the plurality of nozzles and without driving nozzles that are not included in the nozzle group among the plurality of nozzles, to discharge ink onto the recording medium;

conveying the recording medium in the predetermined direction, after the first recording, for a distance corresponding to a width of the nozzle group;

performing second recording for recording a second dot pattern on the conveyed recording medium by driving the nozzle group to discharge ink onto the recording medium;

obtaining, using an optical sensor, a signal value of an image regarding the predetermined direction based on the first dot pattern and the second dot pattern; and determining, based on the obtained signal value, whether a discharge nozzle performing defective discharge exists among the nozzle group.

2. The method according to claim 1, further comprising:

adjusting a recording position by using a first adjustment pattern recorded using the nozzle group with the recording head being moved in a forward scanning direction and a second adjustment pattern recorded using the nozzle group with the recording head being moved in a backward scanning direction without conveying the recording medium after the recording of the first adjustment pattern.

3. The method according to claim 2, further comprising performing, based on determining whether a discharge nozzle performing defective discharge exists, second determining in a manner such that a number of discharge nozzles performing defective discharge among the nozzle group is obtained, wherein, in a case where the obtained number of discharge nozzles is smaller than a predetermined threshold, a value which is based on a result of reading of the first adjustment pattern and the second adjustment pattern is determined as an adjustment value to be used for adjusting a deviation of the recording position of the recording head, and wherein, in a case where the obtained number of the discharge nozzles is equal to or larger than the predetermined threshold, the value which is based on the result of the reading of the first adjustment pattern and the second adjustment pattern is not determined as the adjustment value.

4. The method according to claim 3, wherein, in a case where the obtained number of the discharge nozzles is equal to or larger than the predetermined threshold, determining includes determining either a preliminarily stored initial value or a value determined in a previous determining is determined as the adjustment value.

5. The apparatus according to claim 4, wherein, in a case where the obtained number of the discharge nozzles is equal to or larger than the predetermined threshold, the determining unit determines either a preliminarily stored initial value or a value determined in a previous determining is determined as the adjustment value.

6. The apparatus according to claim 2, wherein the first dot pattern, the second dot pattern, the first adjustment pattern, and the second adjustment pattern are recorded on one print medium.

7. The method according to claim 1, wherein the plurality of nozzles are arranged in the predetermined direction, at certain intervals.

8. The method according to claim 1, wherein the first recording is performed by moving the recording head in a forward scanning direction and the second recording is performed by moving the recording head in a backward scanning direction.

9. The method according to claim 1, wherein the first recording and the second recording are performed by moving the recording head in a same direction.

10. The method according to claim 1, wherein the signal value obtained by the optical sensor is one of luminance, optical density, and an L*a*b color specification system.

11. A recording apparatus for recording, the recording apparatus comprising:

a recording head, wherein the recording head includes a nozzle array having a plurality of nozzles for discharging ink arranged in a predetermined direction and is configured to perform reciprocating movement in a scanning direction crossing the predetermined direction;

a recording unit configured to perform first recording to record a first dot pattern on a recording medium by driving a nozzle group including a series of some nozzles, but not all of the nozzles, among the plurality of nozzles, and without driving nozzles that are not included in the nozzle group among the plurality of nozzles, to discharge ink onto the recording medium;

a conveying unit configured to convey the recording medium in the predetermined direction, after the first recording, for a distance corresponding to a width of the nozzle group, wherein, in response to the conveying unit conveying the recording medium in the predetermined direction, the recording unit performs second recording to record a second dot pattern on the conveyed recording medium by driving the nozzle group to discharge ink onto the recording medium;

an optical sensor configured to obtain a signal value of an image regarding the predetermined direction based on the first dot pattern and the second dot pattern; and a determining unit configured to determine, based on the obtained signal value, whether a discharge nozzle performing defective discharge exists among the nozzle group.

12. The recording apparatus according to claim 11, further comprising:

an adjusting unit configured to adjust a recording position by using a first adjustment pattern recorded using the nozzle group with the recording head being moved in a forward scanning direction and a second adjustment pattern recorded using the nozzle group with the recording head being moved in a backward scanning direction without conveying the recording medium after the recording of the first adjustment pattern.

13. The recording apparatus according to claim 11, wherein the plurality of nozzles are arranged in the predetermined direction, at certain intervals.

14. The recording apparatus according to claim 11, wherein the first recording is performed by moving the recording head in a forward scanning direction and the second recording is performed by moving the recording head in a backward scanning direction.

15. The recording apparatus according to claim 11, wherein the first recording and the second recording are performed by moving the recording head in a same direction.

16. The recording apparatus according to claim 11, wherein the signal value obtained by the optical sensor is one of luminance, optical density, and an L*a*b color specification system.

17. The apparatus according to claim 11, further comprising a performing unit configured to perform, based on the determining unit determining whether a discharge nozzle performing defective discharge exists, second determining in a manner such that a number of discharge nozzles performing defective discharge among the nozzle group is obtained, wherein, in a case where the obtained number of discharge nozzles is smaller than a predetermined threshold, a value which is based on a result of reading of the first dot pattern and the second dot pattern is determined as an adjustment value to be used for adjusting a deviation of the recording position of the recording head, and wherein, in a case where the obtained number of the discharge nozzles is equal to or larger than the predetermined threshold, the value which is based on the result of the reading of the first dot pattern and the second dot pattern is not determined as the adjustment value.

18. A non-transitory computer-readable storage medium storing a program to cause a recording apparatus to perform a method, wherein the recording apparatus performs recording with a recording head and includes a nozzle array having a plurality of nozzles for discharging ink arranged in a predetermined direction and performs reciprocating movement in a scanning direction crossing the predetermined direction, the method comprising:

performing first recording for recording a first dot pattern on a recording medium by driving a nozzle group including a series of some nozzles, but not all of the nozzles, among the plurality of nozzles and without driving nozzles that are not included in the nozzle group among the plurality of nozzles, to discharge ink onto the recording medium;

conveying the recording medium in the predetermined direction, after the first recording, for a distance corresponding to a width of the nozzle group;

performing second recording for recording a second dot pattern on the conveyed recording medium by driving the nozzle group to discharge ink onto the recording medium;

obtaining, using an optical sensor, a signal value of an image regarding the predetermined direction based on the first dot pattern and the second dot pattern; and determining, based on the obtained signal value, whether a discharge nozzle performing defective discharge exists among the nozzle group.

* * * * *